US012227856B2

(12) United States Patent
Zhang et al.

(10) Patent No.: US 12,227,856 B2
(45) Date of Patent: Feb. 18, 2025

(54) PROTOCOL FOR THE SYNTHESIS OF BISMUTH VANADATE DOUBLE-LAYER HOMOJUNCTION WITHOUT HETEROATOMS AS PHOTOELECTRODE

(71) Applicant: City University of Hong Kong, Kowloon (HK)

(72) Inventors: Ruiqin Zhang, Kowloon (HK); Haipeng Wang, Kowloon (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 18/174,036

(22) Filed: Feb. 24, 2023

(65) Prior Publication Data

US 2024/0295037 A1 Sep. 5, 2024

(51) Int. Cl.
*C23C 28/00* (2006.01)
*C23C 28/02* (2006.01)
(Continued)

(52) U.S. Cl.
CPC ..... *C25B 11/053* (2021.01); *C25B 1/04* (2013.01); *C25B 9/50* (2021.01); *C25B 11/077* (2021.01);
(Continued)

(58) Field of Classification Search
CPC .... C25D 5/10; C25D 3/54; C25D 5/54; C23C 28/04; C23C 28/042; C23C 28/00; C23C 28/02
(Continued)

(56) References Cited

FOREIGN PATENT DOCUMENTS

WO WO-2018133197 A1 * 7/2018 ..... C25B 11/04

OTHER PUBLICATIONS

Qin et al., "High Quantum Efficiency Achieved on BiVO4 Photoanode for Efficient Solar Water Oxidation," Solar RRL. (Dec. 2019), vol. 3, No. 12, pp. 1-8. (Year: 2019).*
(Continued)

*Primary Examiner* — Edna Wong
(74) *Attorney, Agent, or Firm* — Renner, Kenner, Greive, Bobak, Taylor & Weber

(57) ABSTRACT

A photoelectrode includes a double-layer homojunction of metal oxide semiconductor films without heteroatoms incorporated. The metal oxide semiconductor films are uniform in large size with rich oxygen vacancies. For $BiVO_4$ films, Bi precursor can be electrodeposited on a substrate under atmospheric pressure and air atmosphere. The electrolytes for electrodeposition are acidic or alkaline with controllable pHs. The electrodeposited substrate is transferred to the muffle furnace for thermal evaporation with V precursor. Film thickness and size can be controlled by electrodeposition parameters. The $BiVO_4$ double-layer homojunction is a safer and cheaper material in photo-driven devices, hydrogen producers, and solar cells, and is an economical replacement of costly III-V compounds, polymers, and valuable fossil. The $BiVO_4$ double-layer homojunction can also be employed as photoelectrodes for $H_2$ production via photoelectrochemical (PEC) water splitting under solar light, which can provide pivotal reactor materials for hydrogen producers and solar cells.

8 Claims, 13 Drawing Sheets

(51) Int. Cl.

| | |
|---|---|
| ***C25B 1/04*** | (2021.01) |
| ***C25B 9/50*** | (2021.01) |
| ***C25B 11/053*** | (2021.01) |
| ***C25B 11/077*** | (2021.01) |
| ***C25D 3/54*** | (2006.01) |
| ***C25D 5/10*** | (2006.01) |
| ***C25D 5/50*** | (2006.01) |
| ***C25D 5/54*** | (2006.01) |
| ***C25D 7/12*** | (2006.01) |

(52) U.S. Cl.
CPC ..... *C25D 3/54* (2013.01); *C25D 5/10* (2013.01); *C25D 5/50* (2013.01); *C25D 7/12* (2013.01)

(58) Field of Classification Search
USPC ..... 205/192, 220, 159, 162, 227
See application file for complete search history.

(56) References Cited

OTHER PUBLICATIONS

Huang et al., "Twin Structure in BiVO4 Photoanodes Boosting Water Oxidation Performance Through Enhanced Charge Separation and Transport," Advanced Energy Materials (Nov. 2018), vol. 8, No. 32, pp. 1-7. (Year: 2018).*
Qin et al., "Crystal Size-Controlled Growth of Bismuth Vanadate for Highly Efficient Solar Water Oxidation," Sustainable Energy & Fuels (2021), vol. 5, No. 4, pp. 1129-1133. (Year: 2021).*
Fuentes-Camargo et al. "Pulse-Plating Electrodeposition of Metallic Bi in an Organic-Free Aqueous Electrolyte and its Conversion into BiVO4 to Improve Photoelectrochemical Activity Toward Pollutant Degradation Under Visible Light," The Journal of Physical Chemistry C. (Dec. 17, 2019), vol. 124, No. 2, (Year: 2019).*
(Continuation of "X"): pp. 1421-1428. (Year: 2019).*
Wu et al., "Multi-Layer Monoclinic BiVO4 with Oxygen Vacancies and V4+ Species for Highly Efficient Visible-Light Photoelectrochemical Applications," Applied Catalysis B: Environmental (Feb. 1, 2018), vol. 221, pp. 187-195. (Year: 2018).*
Yasuhiro Tachibana, et al., Artificial photosynthesis for solar water-splitting, Nature Photonics, vol. 6 (Aug. 2012) 511-518.
Nadarajah Kannan & Divagar Vakeesan, Solar energy for future world: A review, Renewable & Sustainable Energy Reviews 62 (2016) 1092-1105.
Stephane Abanades, et al., Screening of water-splitting thermochemical cycles potentially attractive for hydrogen production by concentrated solar energy, Energy 31 (2006) 2805-2822.
Miaoyan Huang, et al., In situ textured carbon nitride photoanodes with enhanced photoelectrochemical activity by band-gap state modulation, J. Mater. Chem. A., 2020, 8, 24005.
Akira Fujishima, et al., Electrochemical Photolysis of Water at a Semiconductor Electrode, Nature vol. 238 (Jul. 7, 1972) 37-38.
Xingsheng Hu, et al., The hydrophilic treatment of a novel co-catalyst for greatly improving the solar water splitting performance over Mo-doped bismuth vanadate, J. Colloid & Interface Science 607 (2022) 219-228.
Bokai Kang, et al., Green electrodeposition synthesis of NiFe—LDH/MoOx/BiVO4 for efficient photoelectrochemical water splitting, J. Colloid & Interface Science 626 (2022) 146-155.
Yong Peng, et al., Suppressing photoinduced charge recombination at the BiVO4//NiOOH junction by sandwiching an oxygen vacancy layer for efficient photoelectrochemical water oxidation J. Colloid & Interface Science, 608 (2022) 1116-1125.
Subbiramaniyan Kubendhiran, et al., Rational design of W-doped BiVO4 photoanode coupled with FeOOH for highly efficient photoelectrochemical catalyzing water oxidation, Int'l. J. of Hydrogen Energy (2020), 47(63), 27012-27022.
Satyananda Kishore Pilli, et al., Cobalt-phosphate (Co—Pi) catalyst modified Mo-doped BiVO4 photoelectrodes for solar water oxidation, Energy Environ. Sci., 2011, 4, 5028.
Meirong Huang, et al., Twin Structure in BiVO4 Photoanodes Boosting Water Oxidation Performance through Enhanced Charge Separation and Transport, Adv. Energy Mater. 2018, 8, 1802198.
Hyun Soo Han, et al., Boosting the solar water oxidation performance of a BiVO4 photoanode by crystallographic orientation control, Energy Environ. Sci., 2018, 11, 1299.
Gopichand Talasila, et al., Modified synthesis of BiVO4 and effect of doping (Mo or W) on its photoelectrochemical performance for water splitting, Energy Reports 6 (2020) 1963-1972.
Hyun S. Park, et al., Factors in the Metal Doping of BiVO4 for Improved Photoelectrocatalytic Activty as Studied by Scanning Electrochemical Microscopy and First-Principles Density-Functional Calculation, J. Phys. Chem. C 2011, 115, 17870-17879.
Miaoyan Huang, et al., Low-dimensional Mo:BiVO4 photoanodes for enhanced photoelectrochemical activity, J. Mater. Chem. A., 2018, 6, 3602.
Jinzhan Su, et al., Enhanced Photoelectrochemical Performance of the BiVO4/Zn:BiVO4 Homojunction for Water Oxidation, ChemCatChem 2016, 8, 1-9.
Jae Myeong Lee, et al., A Zn:BiVO4/Mo:BiVO4 homojunction as an efficient photoanode for photoelectrochemical water splitting, J. Mater. Chem. A., 2019, 7, 9019.
Wanqing Fang, et al., Highly Active and Self-Healing Co-Doped BiVO4 Photoanode in Borate Buffer to Enhance Charge Separation and Water Oxidation Kinetics during Photoelectrochemical Water Splitting, ACS Appl. Energy Mater. 2022, 5, 6313-6323.
Jiafu Qu, et al., Construction of BiVO4/NiCo204 nanosheet Z-scheme heterojunction for highly boost solar water oxidation, J. of Colloid & Interface Science 613 (2022) 265-275.
Chongfei Yu, et al., Preparation and characterization of sphere-shaped BiVO4/reduced graphene oxide photocatalyst for an augmented natural sunlight photocatalytic activity, J. of Alloys and Compounds 677 (2016) 219-227.
Ch. Venkata Reddy, et al., Effect of noble metal ions dopants on solar photoelectrochemical water splitting and electrochemical supercapacitive performance of BiVO4 hollow tubes, Solar Energy Mater. & Solar Cells 226 (2021) 111056.
Ch. Venkata Reddy, et al., Au-doped BiVO4 nanostructure-based photoanode with enhanced photoelectochemical solar water splitting and electrochemical energy storage ability, Applied Surface Science 545 (2021) 149030.
Xiufang Zhang, et al., Preparation of Ag doped BiVO4 film and its enhanced photoelectrocatalytic (PEC) ability of phenol degradation under visible light, J. of Hazardous Materials 167 (2009) 911-914.
Qi Qin, et al., High Quantum Efficiency Achieved on BiVO4 Photoanode for Efficient Solar Water Oxidation, Sol. RRL 2019, 3, 1900301.
Hui Ling Tan, et al., BiVO4 {010} and {110} Relative Exposure Extent: Governing Factor of Surface Charge Population and Photocatalytic Activity, J. Phys. Chem. Lett. 2016, 7, 1400-1405.
Songcan Wang, et al., New BiVO4 Dual Photoanodes with Enriched Oxygen Vacancies for Efficient Solar-Driven Water Splitting, Adv. Mater. 2018, 30, 1800486.
Jin-Meng Wu, et al., Multi-layer monoclinic BiVO4 with oxygen vacancies and V4+ species for highly efficient visible- ight photoelectrochemical applications, Applied CatalystsB: Environmental 221 (2018) 187-195.
Kin Zhao, et al., Clarifying the Roles of Oxygen Vacancy in W-Doped BiVO4 for Solar Water Splitting, ACS Appl. Energy Mater. 2018, 1, 3410-3419.
Dechao Kong, et al., Ni-Doped BiVO4 with V4+ Species and Oxygen Vacancies for Efficient Photoelectrochemical Water Splitting, Transactions of Tianjin University (2019) 25:340-347.
Wennie Wang, et al., The Role of Surface Oxygen Vacancies in BiVO4, Chem. Mater. 2020, 32, 2899-2909.
Ming Fang, et al., Mo-doping induced crystal orientation reconstruction and oxygen vacancy on BiVO4 homojunction for enhanced solar-driven water splitting, Chem. Eng. J. (2020) 127796.

(56) References Cited

OTHER PUBLICATIONS

Muhammad Munir Sajid, et al., Synthesis of Zn3(VO4)2/BiVO4 heterojunction composite for the photocatalytic degradation of methylene blue organic dye and electrochemical detection of H202, Rsc Adv., 2018, 8, 35403.
Wan-Jian Yin, et al., Doping properties of monoclinic BiVO4 studied by first-principles density-functional theory, Bysical Review B 83, 155102 (2011).
Noseung Myung, et al., Tailoring Interfaces for Electrochemical Synthesis of Semiconductor Films: BiVO4, Bi203, or Composites, J. Phys. Chem. C 2011, 115, 7793-7800.
Pengfei Yue, et al., Super-hydrophilic CoAl—LDH on BiVO4 for enhanced photoelectrochemical water oxidation activity, Applied Catalysis B: Environmental 286 (2021) 119875.

* cited by examiner

PROTOCOL FOR THE SYNTHESIS OF BISMUTH VANADATE DOUBLE-LAYER HOMOJUNCTION WITHOUT HETEROATOMS AS PHOTOELECTRODE

FIELD OF THE INVENTION

This invention relates to a photoelectrode. Specifically, this invention relates to a photoelectrode including a homojunction of metal oxide semiconductor films.

BACKGROUND OF THE INVENTION

Solar energy has been an attractive energy source because it is clean, widely spreading, easy to achieve, and inexpensive. The past decades have witnessed the rapid development of solar energy by photoelectrolysis of water. The Photoelectrochemical (PEC) water-splitting technique harvesting solar energy directly from the Sun provides an ideal way to achieve hydrogen ($H_2$) with minimal environmental impact. In the PEC process, the semiconductor-based photoelectrode is excited by the sunlight and can generate electron-hole pairs, the separation of which provides electrons, facilitating the oxygen evolution reaction (OER) to occur at the photoanode and the hydrogen evolution reaction (HER) to occur at the photocathode. Among all the investigated semiconductor materials, bismuth vanadium ($BiVO_4$) has been widely used as a promising photoanode for PEC water splitting due to its advantages of relatively narrow bandgap (~2.4 eV), the appropriate band edge position, relatively high chemical stability, non-toxicity and low cost.

Despite all the attractive advantages, $BiVO_4$ photoanodes still suffer from some drawbacks, such as long electrical conductivity, long carrier diffuse length and low charge mobility. The theoretical maximum photocurrent density of $BiVO_4$ under standard Air-Mass 1.5 Global (AM 1.5 G) solar light illumination is ~7.5 mA/cm$^2$. But in practical applications, the achieved photocurrent density is much lower than that. Various strategies have been applied to $BiVO_4$ photoanode to optimize its PEC performance, including regulating the composition by element doping, forming the homojunction, constructing the p-n heterojunction, modification of the surface with a cocatalyst. For the homojunction construction strategy, various kinds of dopants are incorporated into the pristine $BiVO_4$ to regulate its electronic structure and then form the homojunction structures with the other modified/pristine $BiVO_4$ component. However, excess heteroatoms incorporated in the host semiconductor always leave some drawbacks, such as introducing the recombination center, forming non-conductive impurities and reducing the photostability, etc. Besides, previous methods for fabricating metal oxide thin film homojunction adopted heteroatoms incorporated, such as Mo or W, to improve the original drawbacks. But the high price of chemicals of heteroatoms increases the cost and the dopant of heteroatoms adds one step to the processes and further enhances the technical difficulty. These hinder their industrial-scale and public applications.

Thus, it is of great significance to construct $BiVO_4$ homojunction structures without introducing the heteroatoms to realize its practical PEC applications in the future.

SUMMARY OF THE INVENTION

An embodiment of the present invention relates to a photoanode including a double-layer homojunction, where the double-layer homojunction includes two layers of a metal oxide semiconductor film.

An embodiment of the present invention also relates to a method for fabricating a photoelectrode including a double-layer homojunction, including the steps of:

(a) providing a bismuth precursor;
(b) providing a substrate;
(c) depositing the bismuth precursor onto the substrate via electrodeposition;
(d) providing a vanadium precursor;
(e) thermal evaporating the vanadium precursor onto the substrate with the bismuth precursor under ambient pressure;
(f) cooling down the substrate to form a first layer of $BiVO_4$ film;
(g) depositing the bismuth precursor onto the substrate of (f) via electrodeposition;
(h) thermal evaporating the vanadium precursor onto the substrate with the bismuth precursor under ambient pressure; and
(i) cooling down the substrate to form a second layer of $BiVO_4$ film.

An embodiment of the present invention also relates to a photoelectrode including a plurality of homojunctions, where at least one; or each, homojunction includes two metal oxide semiconductor films. In such an embodiment, each metal oxide semiconductor film is formed via electrodeposition in an alkaline electrolyte or an acidic electrolyte.

Without intending to be limited by theory it is believed that the present invention may provide a novel photoelectrode including a double-layer homojunction of metal oxide semiconductor films without heteroatoms incorporated. The metal oxide semiconductor films such as bismuth vanadate ($BiVO_4$) films are uniform in large size with rich oxygen vacancies. The Bi precursor can be electrodeposited on various substrates under atmospheric pressure and air atmosphere without incorporating heteroatoms. The electrolytes for electrodeposition are acidic or alkaline with controllable pHs. The electrodeposited substrate is transferred to the muffle furnace for thermal evaporation with V precursor. The thickness and size of the films can be easily controlled by changing electrodeposition parameters. The double-layer homojunction is stable in aqueous electrolytes and prolonged mechanical cycling. This invention is expected to lead to advanced applications of metal oxide films in PEC cells, hydrogen producers, solar cells, and photocatalysis. The fabricating method of the photoelectrode is facile and noncomplex by the deposition of thin films with controlled surface morphology, thickness, and size. The materials are also economical and non-toxic.

The $BiVO_4$ double-layer homojunction can be used as a safer and cheaper material in photo-driven devices, hydrogen producers, and solar cells. The $BiVO_4$ double-layer homojunction is comparatively economical, hence can replace the costly III-V compounds, polymers, and valuable fossil materials for various applications. The $BiVO_4$ double-layer homojunction can also be employed as photoelectrodes for $H_2$ production via photoelectrochemical (PEC) water splitting under solar light, which can provide pivotal reactor materials for hydrogen producers and solar cells.

Figure 1:
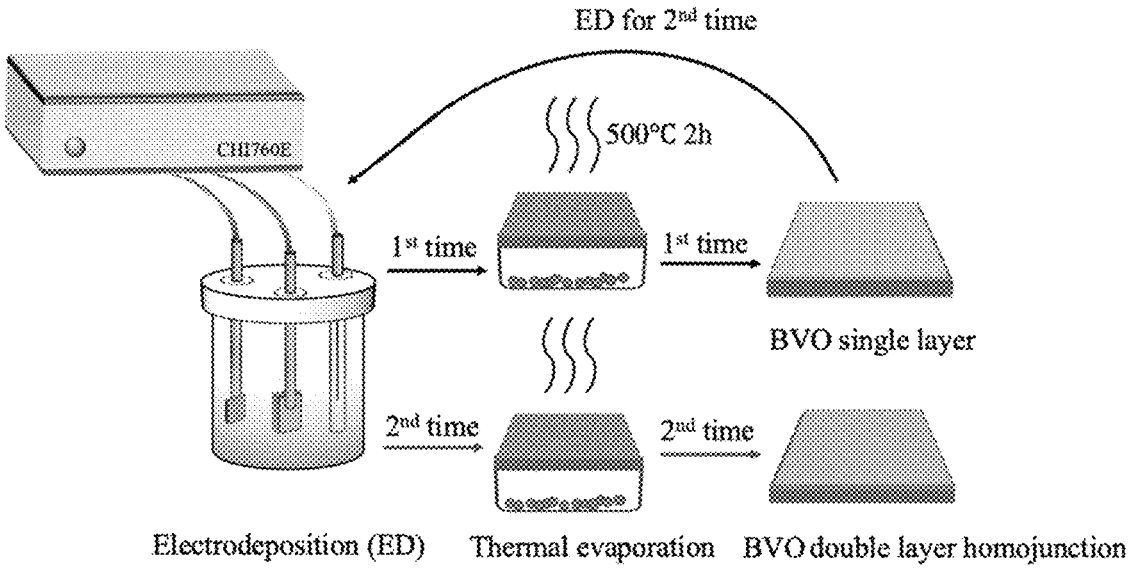
FIG. 1 is a diagram showing a schematic representation of an embodiment of the fabrication process of $BiVO_4$ single-layer film and $BiVO_4$ double-layer homojunction.

The figures herein are for illustrative purposes only and are not necessarily drawn to scale.

DETAILED DESCRIPTION OF PREFERRED EMBODIMENTS

Unless otherwise specifically provided, all tests herein are conducted at standard conditions which include a room and testing temperature of about 25° C., sea level (1 atm.) pressure, pH 7 if not specified, and all measurements are made in metric units. Furthermore, all percentages, ratios, etc. herein are by weight, unless specifically indicated otherwise. It is understood that unless otherwise specifically noted, the materials compounds, chemicals, etc. described herein are typically commodity items and/or industry-standard items available from a variety of suppliers worldwide.

Without intending to be limited by theory, it is believed that an acidic electrolyte herein means the pH of electrolyte is below 7, more specifically, within about 0.1 to less than 7 (where a pH of 7 is excluded). In contrast, an alkaline electrolyte herein means the pH of the electrolyte is above 7, more specifically, within about more than 7 to about 14 (where a pH of 7 is excluded). A pH of 7 is considered to be neutral.

An embodiment of the present invention relates to a photoanode including a double-layer homojunction, where the double-layer homojunction includes two layers of a metal oxide semiconductor film; or a first layer of a metal oxide semiconductor film and a second layer of a metal oxide semiconductor film. In an embodiment herein, the metal oxide semiconductor film contains a $BiVO_4$ film; or a $BiVO_4$ film containing only $BiVO_4$. In an embodiment herein, the $BiVO_4$ film is a pure $BiVO_4$ film without a (typical) metal heteroatom. Without intending to be limited by theory, it is believed that the homojunction structure herein possesses a built-in electric field that can facilitate the electron-hole separation at the $BVO_{ac}$/$BVO_{al}$ interface which can improve the PEC performance. Furthermore, it is believed that without the need for incorporating (typical) metal heteroatoms, the photoanode of $BiVO_4$ homojunction is cheaper and easier to manufacture.

In an embodiment herein, one of the two layers of the metal oxide semiconductor films of the photoanode is formed via electrodeposition in an acidic electrolyte.

In an embodiment herein, one of the two layers of the metal oxide semiconductor film of the photoanode is formed via electrodeposition in an alkaline electrolyte. The films deposited in acidic or alkaline electrolytes have different electronic structures and different amounts of oxygen vacancies respectively so that the built-in electric field can be constructed.

In an embodiment herein, one of the two layers of metal oxide semiconductor film is formed via electrodeposition in an acidic electrolyte, and the other layer of metal oxide semiconductor films is formed via electrodeposition in an alkaline electrolyte.

In an embodiment herein, the double-layer homojunction comprises a first layer and a second layer, wherein the first layer of the metal oxide semiconductor film is formed via electrodeposition in an acidic electrolyte, and the second layer of the metal oxide semiconductor film is formed via electrodeposition in an alkaline electrolyte. Without intending to be limited by theory, it is believed that a homojunction is formed by two layers adhesive to each other. The second layer is deposited directly and closely onto the first layer. A homojunction is sandwiched with two layers of metal oxide semiconductor films. Two layers synthesized by different processes may possesses different oxygen vacancies. The one with more oxygen vacancies can serve as surface electron-trapping sites to promote charge separation and increase the electron conductivity of the $BiVO_4$ photoanode.

In an embodiment herein, the second layer of the metal oxide semiconductor film contains more oxygen vacancies than the first layer of the metal oxide semiconductor film. Without intending to be limited by theory, it is believed that the different concentrations of oxygen vacancies show that the single films have different electronic structures. The combined homojunction also has a built-in electric field which can facilitate the electron-hole separation at the $BVO_{ac}/BVO_{al}$ interface.

In an embodiment herein, the first layer of the metal oxide semiconductor film is electrodeposited in the acidic electrolyte for from about 0.5 minutes to about 120 minutes, or about 25 minutes, and the second layer is electrodeposited in the alkaline electrolyte for from about 10 seconds to about 100 seconds, or about 40 seconds.

Another embodiment herein of the present invention relates to a method for fabricating the photoelectrode, where the substrate is selected from the group of FTO glass, ITO glass, graphitic carbon film and metals. Without intending to be limited by theory it is believed that all conductive substrates are applicable to the present invention. The conductive substrates contain conductive materials.

In an embodiment herein, the step (c) of the method occurs in an acidic electrolyte, and the step (g) of the method occurs in an alkaline electrolyte.

In an embodiment herein, the pH of the acidic electrolyte is about 0.1-7, or about 2. It is believed that the film deposited in an acidic electrolyte (pH=2) has fewer oxygen vacancies than that deposited in an alkaline electrolyte.

In an embodiment herein, the pH of the alkaline electrolyte is about 7-14, or about 13. It is believed that the film deposited in an alkaline electrolyte (pH=13) has more oxygen vacancies than that deposited in an acidic electrolyte.

In an embodiment herein, the step (c) of the method occurs for about 0.5 minutes to about 120 minutes, or about 25 minutes, and the step (g) of the method occurs for about 10 seconds to about 100 seconds, or about 40 seconds.

In an embodiment herein, the thermal evaporating in steps (e) and (h) occurs in a muffle furnace at a temperature of about 300-600° C., or about 500° C. Without intending to be limited by theory, it is believed that, at this annealing temperature, the obtained $BiVO_4$ layer is monoclinic scheelite which can get better PEC performance.

In an embodiment herein, the temperature is controlled at a heating rate of about 0.5-30° C./min, or about 2-3° C./min. It is believed that the temperature-controlling rate of about 2° C./min is optimized for the formation of monoclinic scheelite $BiVO_4$.

In an embodiment herein, the thermal evaporating in steps (e) and (h) takes about 0.1-5 hours, or about 2-3 hours. The reaction time of about 2 hours is optimized for the formation of monoclinic scheelite $BiVO_4$.

Without intending to be limited by theory it is believed that the present invention provides a novel double-layer homojunction fabrication method without heteroatoms incorporated. The oxygen vacancies rich, large size, and uniform metal oxide semiconductor thin films such as bismuth vanadate ($BiVO_4$) films can be synthesized on a substrate under atmospheric pressure and air atmosphere. The precursor materials may be preferably salts and oxides with the Bi precursor. The solvent materials may be acidic or alkaline electrolytes with a controllable pH. The electrodeposition techniques can be applied to synthesize thin films using the precursors. The electrodeposited substrate will be transferred to the muffle furnace for thermal evaporation with V precursor and to design bonding and defects between the precursors of Bi and V. The thickness and size of the films can be easily controlled by changing electrodeposition parameters.

The $BiVO_4$ single-layer film and the $BiVO_4$ double-layer homojunction may be formed by electrodeposition and followed by thermal evaporation. The micro flower-like $BiVO_4$ arrays with sufficient oxygen vacancies may be obtained with this method. In particular, it is believed that the $BiVO_4$ single-layer film electrodeposited in the alkaline (pH=13) electrolyte (denoted as $BVO_{al}$) possesses more oxygen vacancies than that of the single-layer electrodeposited in the acidic (pH=2) electrolyte (denoted as $BVO_{ac}$). Furthermore, it is believed that an n-n+ type-II homojunction photoanode constructed in the present invention consists of $BVO_{ac}$ as the first layer and $BVO_{al}$ as the second layer (denoted as $BVO_{ac}$-$BVO_{al}$ homojunction). The $BiVO_4$ single-layer film electrodeposited in an acidic electrolyte for 25 mins (denoted as $BVO_{ac}$-25) shows a photocurrent density of 1.2 mA/cm$^2$ at 1.23 V versus research hydrogen electrode (RHE) in 0.1 M potassium borate ($K_2B_4O_7 \cdot 4H_2O$) buffer with 0.1 M sodium sulfite ($Na_2SO_3$) as a hole scavenger (pH=9.44) under 1 sunlight illumination (AM 1.5 G, 100 mW/cm$^2$). And the $BiVO_4$ single-layer film that is electrodeposited in the alkaline electrolyte for 40 s (denoted as $BVO_{al}$-40) has a photocurrent density of 1.6 mA/cm$^2$ at 1.23 V vs. RHE under AM 1.5 G illumination. Specifically, the $BVO_{ac}$-$BVO_{al}$ homojunction may exhibit a photocurrent density of 3.6 mA/cm$^2$ at 1.23 V vs. RHE under AM 1.5 G illumination and shows a significant improvement in PEC performance compared to the $BVO_{ac}$-25 and $BVO_{al}$-40 single-layer films. An embodiment of the invention herein therefore provides a convenient way to construct the highly efficient $BiVO_4$ photoanode without introducing any heteroatoms. It is therefore believed that this cost-effective method provides more possibilities for $BiVO_4$-based photoanode for its practical PEC application.

Turning to the figures, FIG. 1A shows the schematic of an embodiment of a fabrication process herein of a $BiVO_4$ single-layer film and $BiVO_4$ double-layer homojunction. The Bismuth precursor is gradually electrodeposited on the fluorine-doped tin dioxide (FTO) glass. And the vanadium precursor reacts with the deposited bismuth precursor at 500° C. for 2 hours to form a $BiVO_4$ single-layer film. The $BiVO_4$ single-layer formation by the aforementioned process may be repeated to obtain a BVO double-layer homojunction.

Figure 2A:
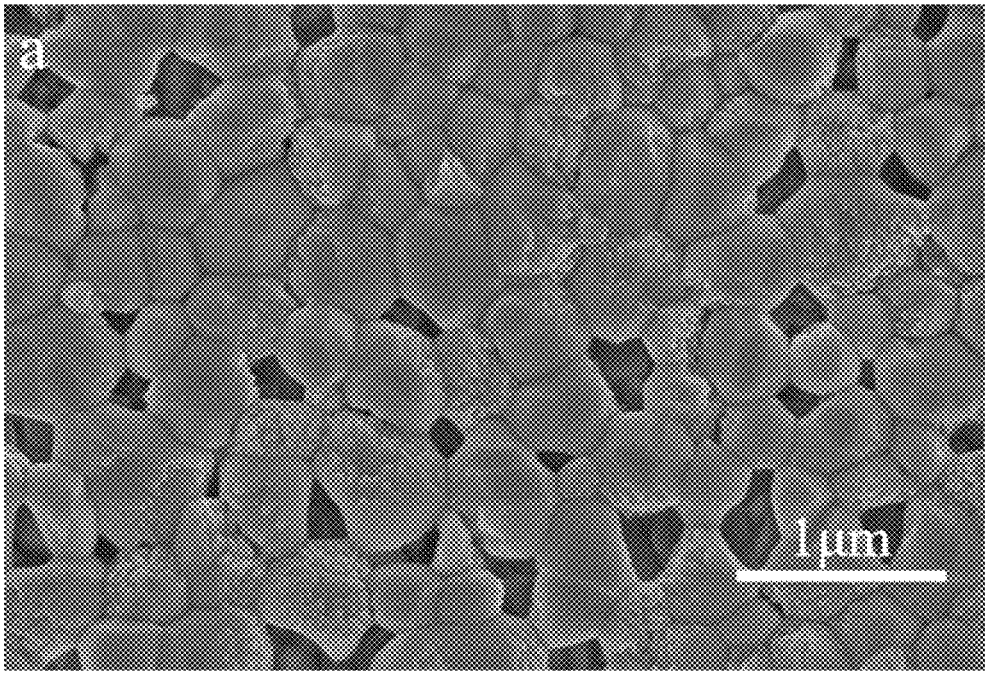
FIG. 2A shows a top-view SEM image of an embodiment of a $BVO_{ac}$-$BVO_{al}$ homojunction at low magnification.
Figure 2B:
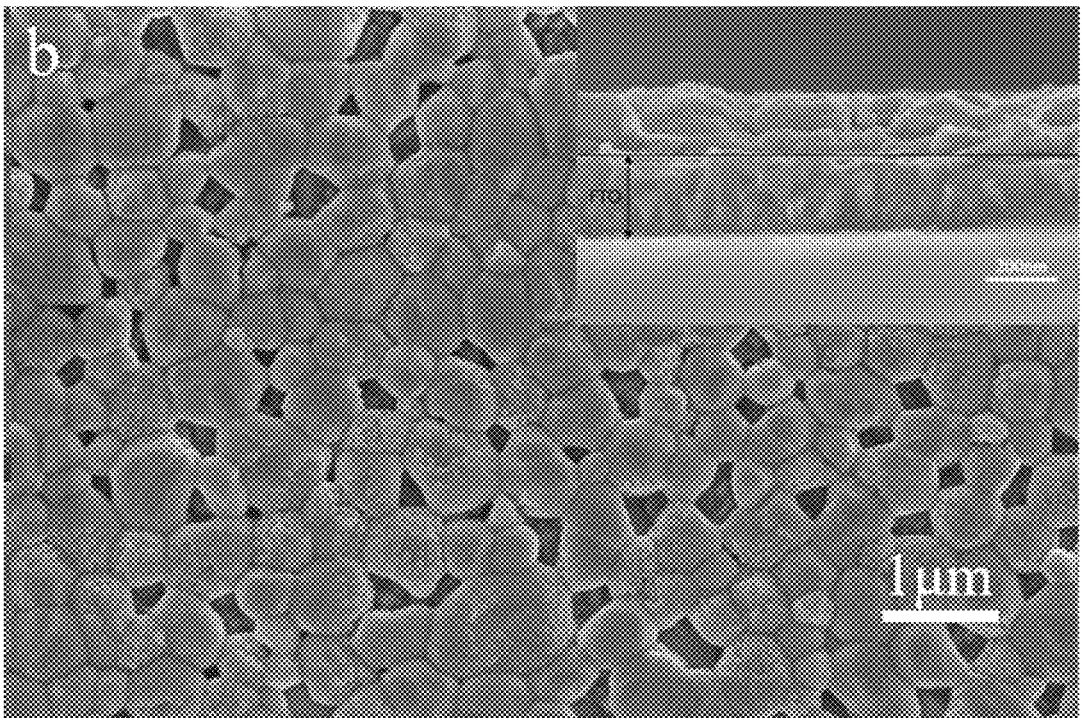
FIG. 2B shows a top-view SEM image and cross-section (inset) view SEM image of an embodiment of a $BVO_{ac}$-$BVO_{al}$ homojunction at high magnification.

FIGS. 2A and 2B show embodiments that $BiVO_4$ films have flower-like surface morphology in the top-view SEM images at both low and high magnifications. FIG. 2B also shows an embodiment of the SEM image of the cross-section of FTO and $BVO_{ac}$-$BVO_{al}$ homojunction. These images show that the synthesized $BiVO_4$ films are uniform, which can effectively solve the problem of surface agglomeration.

Figure 3A:
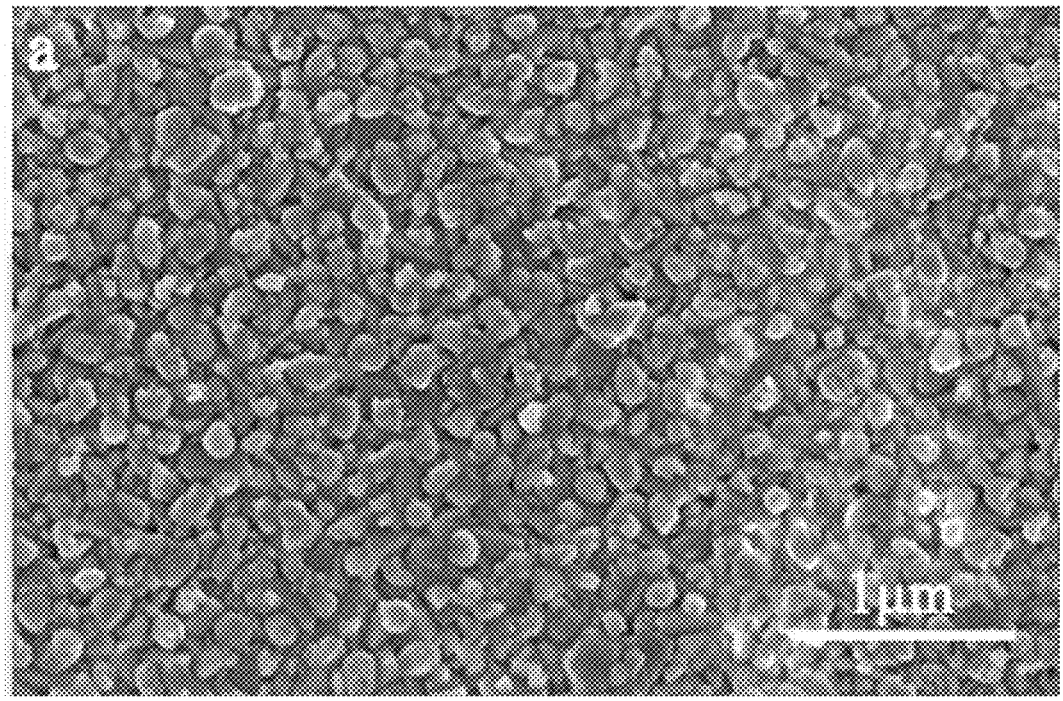
FIG. 3A shows a top-view SEM image of an embodiment of a $BVO_{ac}$-25 at low magnification.
Figure 3B:
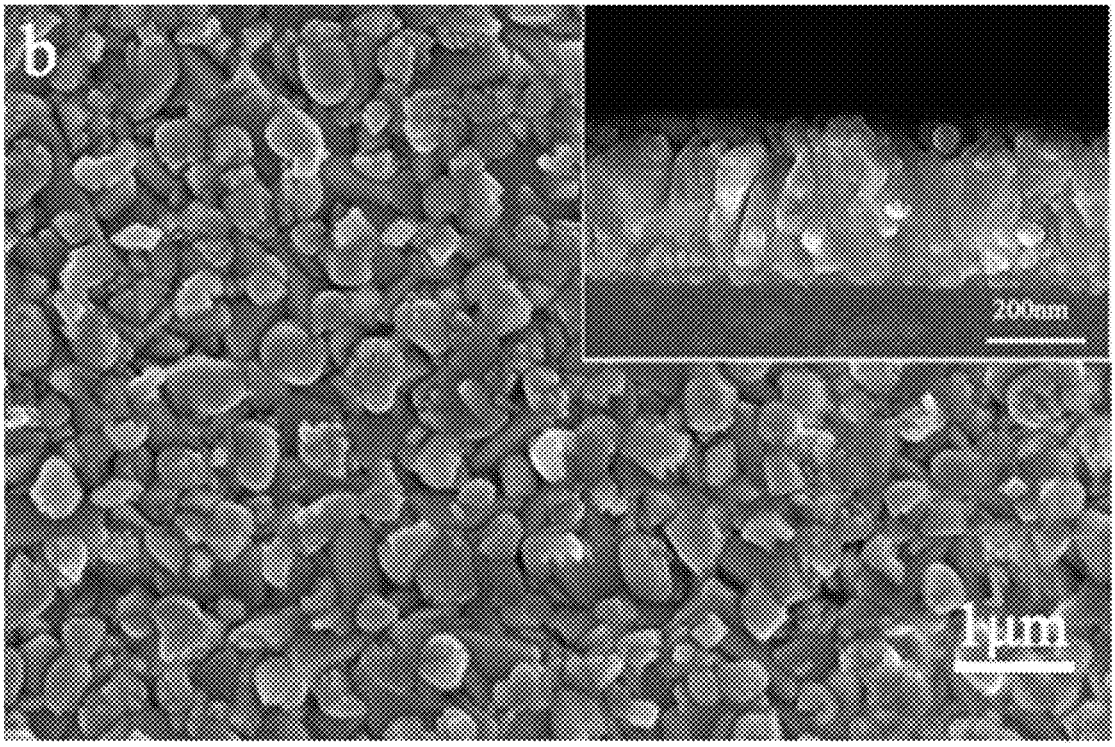
FIG. 3B shows a top-view SEM image and cross-sectional (inset) view SEM image of an embodiment of a $BVO_{ac}$-25 at high magnification
Figure 3C:
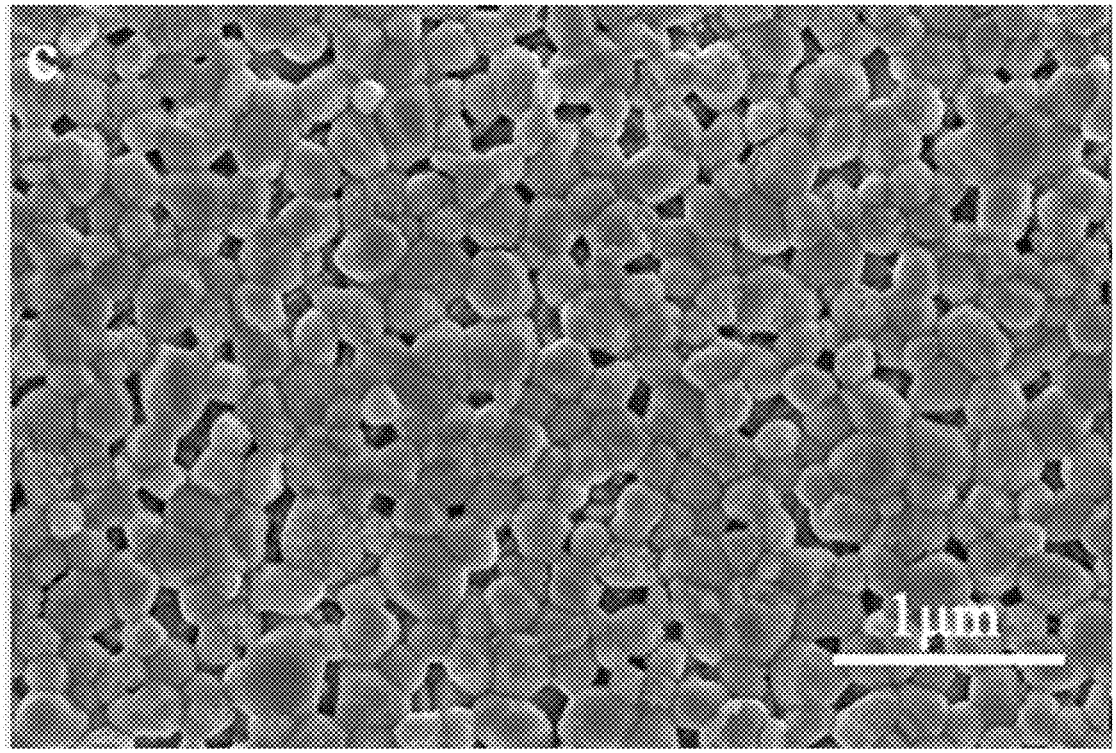
FIG. 3C shows a top-view SEM image of an embodiment of a $BVO_{al}$-40 at low magnification.
Figure 3D:
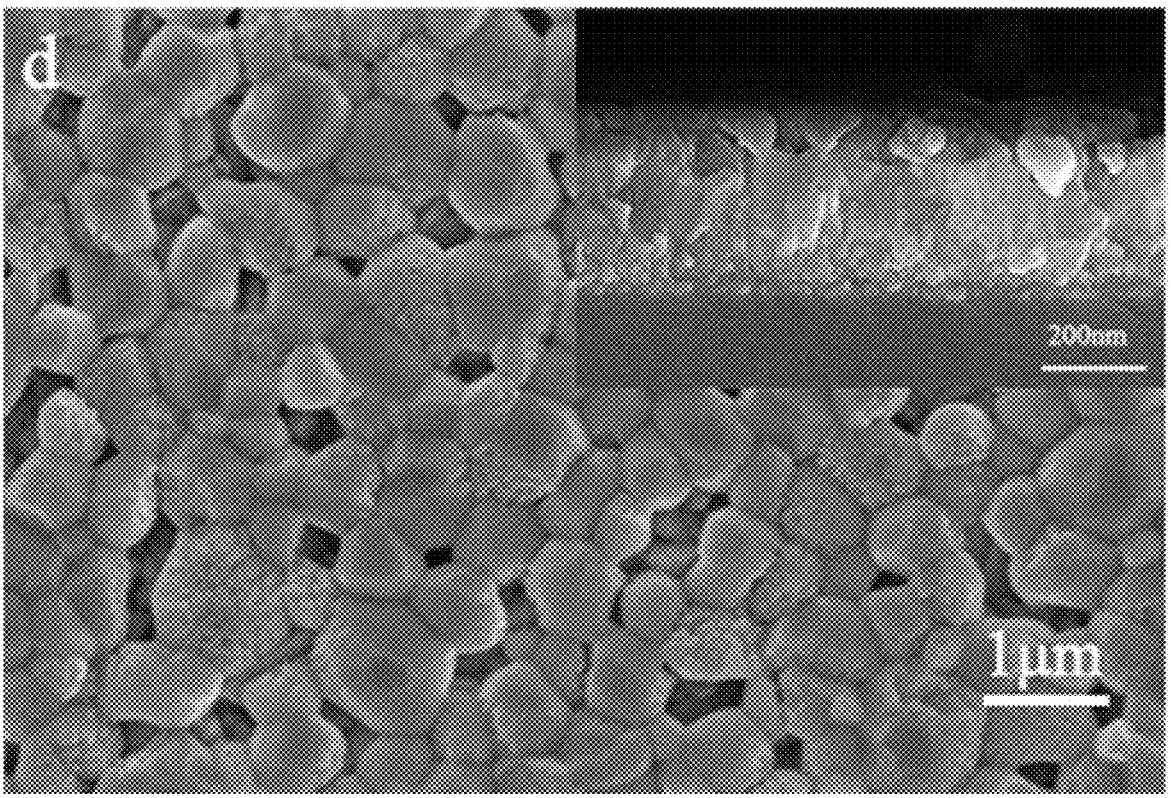
FIG. 3D shows a top-view SEM image and a cross-sectional (inset) view SEM image of an embodiment of a $BVO_{ac}$-40 at high magnification.

FIGS. 3A and 3B show embodiments that $BVO_{ac}$-25 films have flower-like surface morphology in the top-view SEM images at both low and high magnifications. FIG. 3B also shows an embodiment of the SEM image of the cross-section of FTO and $BVO_{ac}$-25. FIGS. 3C and 3D show embodiments that $BVO_{al}$-40 films have flower-like surface morphology in the top-view SEM images at both low and high magnification. FIG. 3D also shows an embodiment of the SEM image of the cross-section of FTO and $BVO_{al}$-40. From these images, the $BVO_{ac}$-25 bare layer possesses a denser topography than $BVO_{al}$-40.

Figure 4:
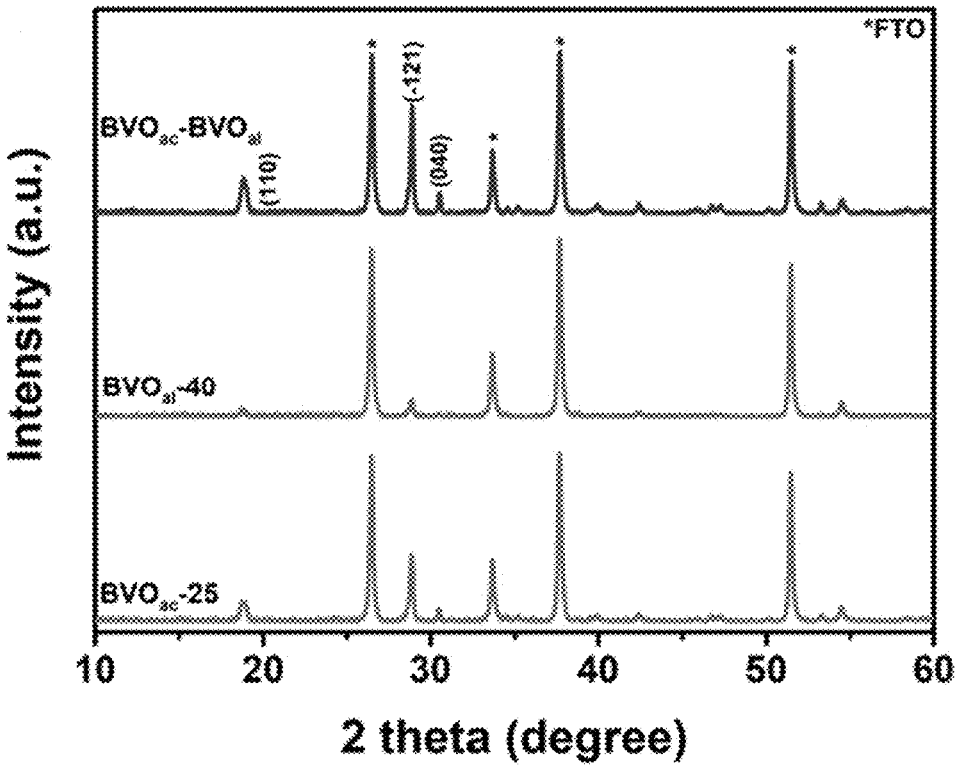
FIG. 4 is a graph showing XRD spectra of an embodiment of a $BVO_{ac}$-25, a $BVO_{al}$-40 and a $BVO_{ac}$-$BVO_{al}$ homojunction.
Figure 5:
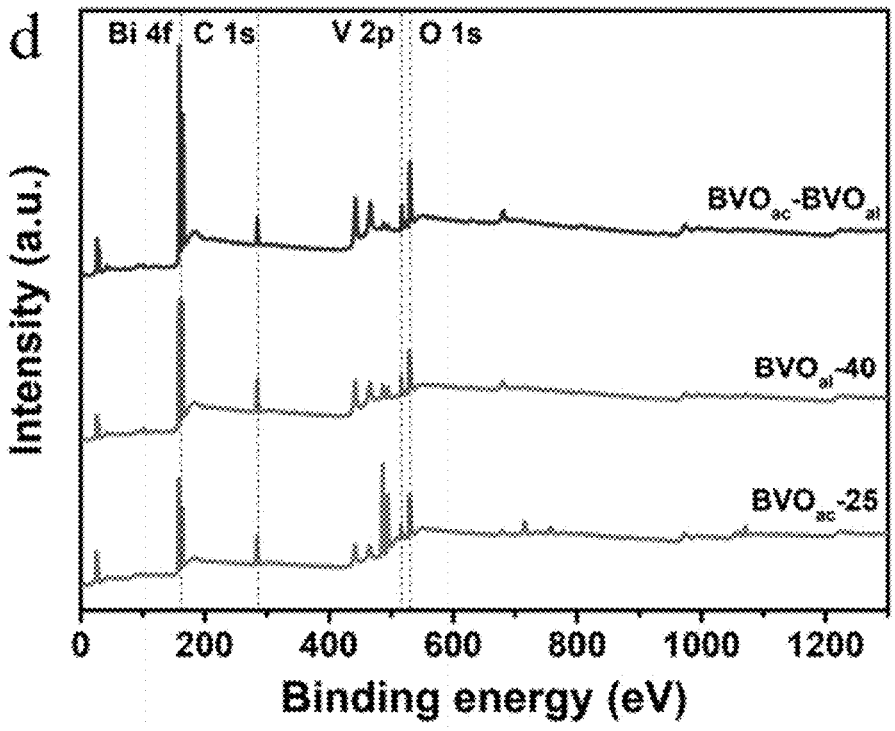
FIG. 5 is a graph showing XPS spectra of an embodiment of a $BVO_{ac}$-25, a $BVO_{al}$-40 and a $BVO_{ac}$-$BVO_{al}$ homojunction.

FIG. 4 is an embodiment of XRD spectra that confirms the structures of prepared $BVO_{ac}$-25, $BVO_{al}$-40 and $BVO_{ac}$-$BVO_{al}$ homojunction. FIG. 5 is an embodiment of XPS spectra showing only Bi, V, C and O elements in the prepared $BVO_{ac}$-25, $BVO_{al}$-40 and $BVO_{ac}$-$BVO_{al}$ homojunction. FIGS. 4 and 5 confirm the structures and purities of prepared $BVO_{ac}$-25, $BVO_{al}$-40 and $BVO_{ac}$-$BVO_{al}$ homojunction that there is no heteroatom incorporated, which is more economical and easier to operate than other reported homojunctions.

Figure 6A:
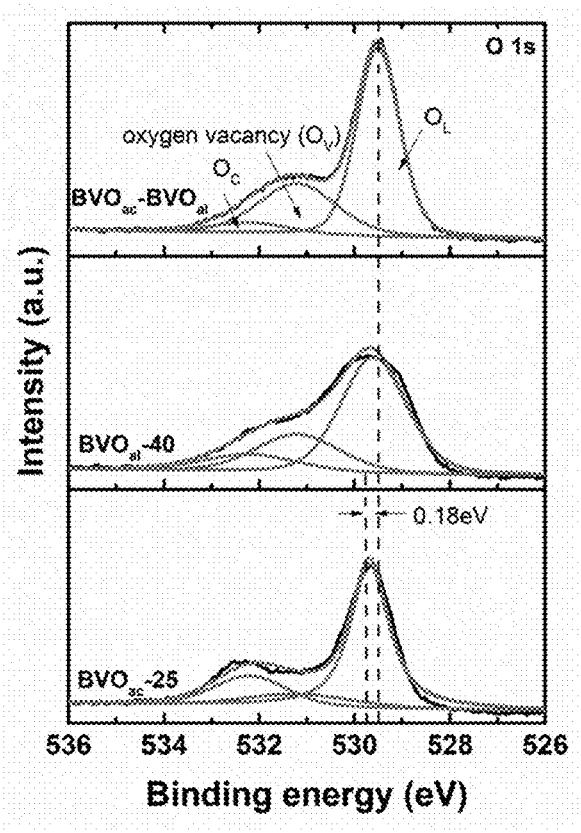
FIG. 6A is a graph showing core-level XPS spectra of O 1s of an embodiment of a $BVO_{ac}$-25, a $BVO_{al}$-40 and a $BVO_{ac}$-$BVO_{al}$ homojunction.
Figure 6B:
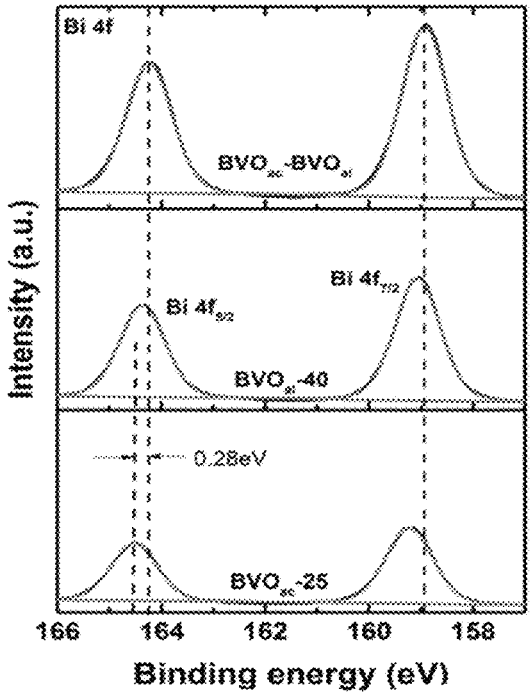
FIG. 6B is a graph showing core-level XPS spectra of Bi 4f of an embodiment of a $BVO_{ac}$-25, a $BVO_{al}$-40 and a $BVO_{ac}$-$BVO_{al}$ homojunction.
Figure 6C:
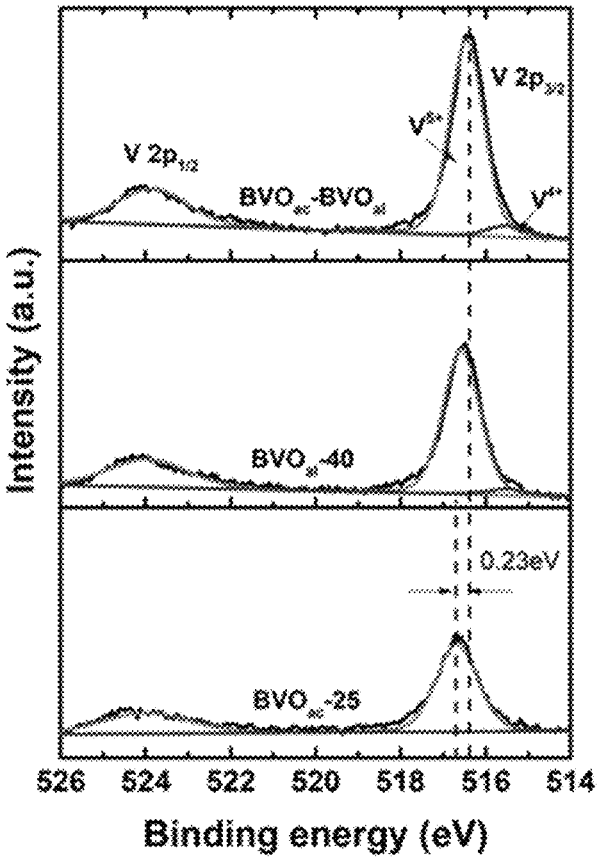
FIG. 6C is a graph showing core-level XPS spectra of V 4f of an embodiment of a $BVO_{ac}$-25, a $BVO_{al}$-40 and a $BVO_{ac}$-$BVO_{al}$ homojunction.

FIG. 6A shows an embodiment of the O 1s XPS spectra for all the $BiVO_4$ films. O 1s spectra is split into three peaks—$O_L$, $O_V$ and $O_C$. FIG. 6B shows an embodiment of the characteristic peaks of 158.93 eV and 164.24 eV rise from Bi $4f_{7/2}$ and Bi $4f_{5/2}$ in the XPS spectra of $BVO_{ac}$-$BVO_{al}$ homojunction. FIG. 6C is an embodiment of V 2p core level XPS spectra showing the content of the $V^{41}$ species in the $BVO_{ac}$-$BVO_{al}$ homojunction is higher than that of $BVO_{ac}$-25 and $BVO_{al}$-40 films.

Figure 7:
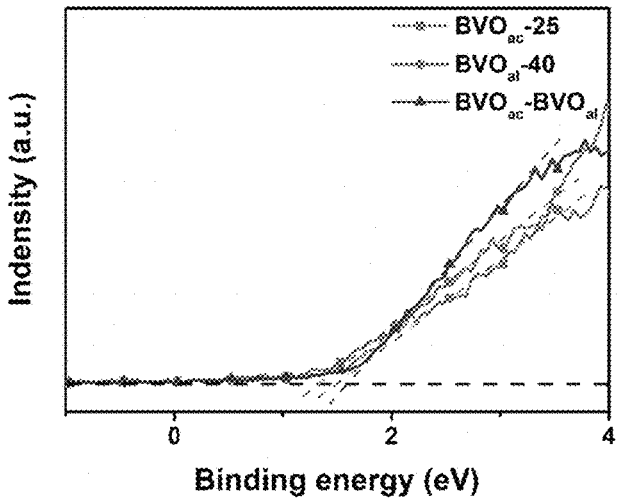
FIG. 7 is a graph showing the valence band position of an embodiment of a $BVO_{ac}$-25, a $BVO_{al}$-40 and a $BVO_{ac}$-$BVO_{al}$ homojunction.

FIG. 7 shows an embodiment of the valence band gap position of $BVO_{ac}$-25, $BVO_{al}$-40 and $BVO_{ac}$-$BVO_{al}$ homojunction.

Figure 8:
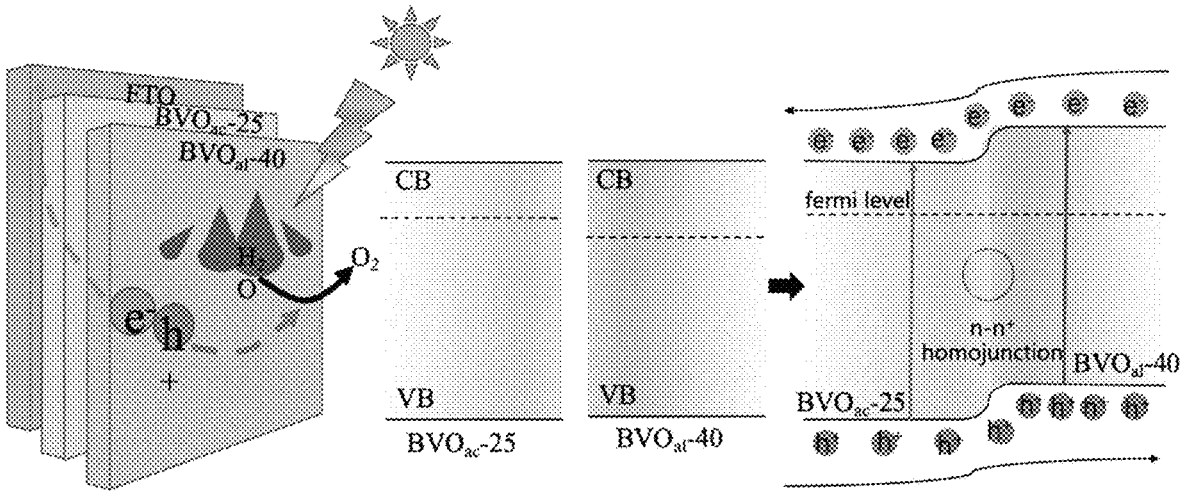
FIG. 8 is a diagram showing an embodiment of the electronic band structure of a $BVO_{ac}$-$BVO_{al}$ homojunction.

FIG. 8 shows an embodiment of the formation and the energy band schematic of the $BVO_{ac}$-$BVO_{al}$ homojunction. The $BVO_{al}$-40 film leads to the shift of the Fermi level to the conduction band (CB) than the $BVO_{ac}$-25. So, there is a relative band bending at the homojunction. It is believed that the different content in oxygen vacancies of the two films causes a relative band bending at the homojunction to enhance the charge separation efficiency across the homojunction.

Figure 9:
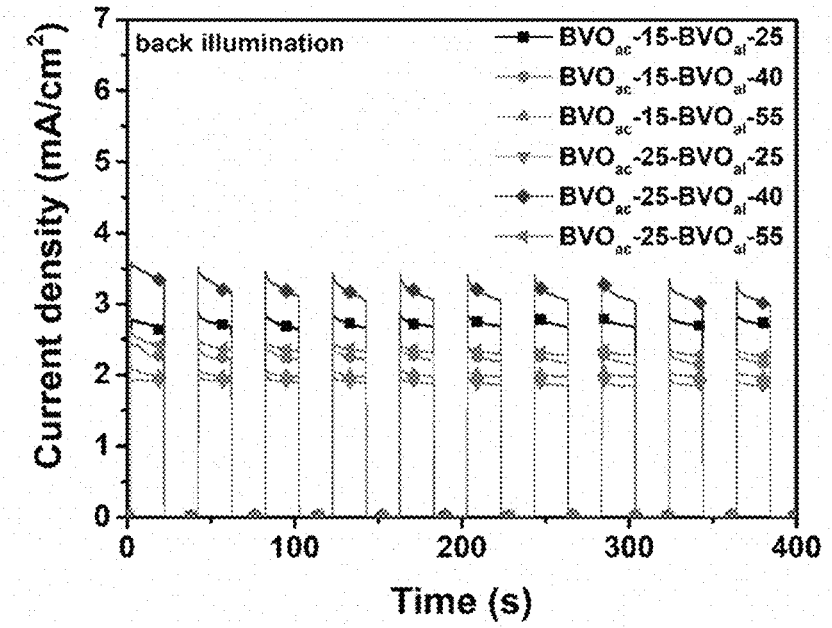
FIG. 9 is a graph showing the transient photocurrent density of various embodiments of a $BiVO_4$ homojunction under illumination in 0.1M potassium borate buffer with 0.1M sodium sulfite at an applied potential of 1.23 V vs RHE.

FIG. 9 compares the current density of $BVO_{ac}$-15-$BVO_{al}$-25, $BVO_{ac}$-15-$BVO_{al}$-40, $BVO_{ac}$-15-$BVO_{al}$-55, $BVO_{ac}$-25-$BVO_{al}$-25, $BVO_{ac}$-25-$BVO_{al}$-40 and $BVO_{ac}$-25-$BVO_{al}$-55. Among them, the $BVO_{ac}$-25-$BVO_{al}$-40 ($BVO_{ac}$-$BVO_{al}$ homojunction) shows the highest current density, which means it has a higher ability for water splitting and other potential applications.

Figure 10A:
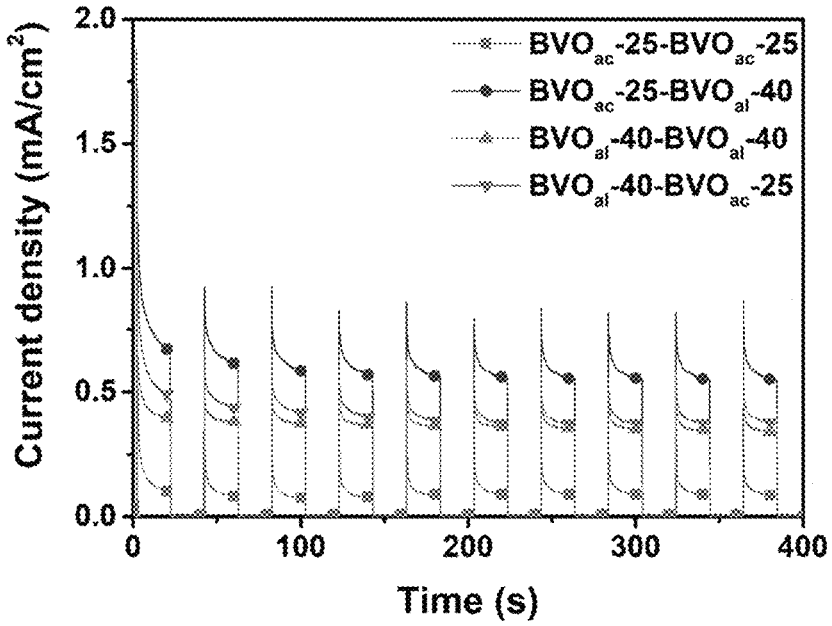
FIG. 10A is a graph showing the transient photocurrent density of an embodiment of a $BVO_{ac}$-$BVO_{ac}$, a $BVO_{ac}$-$BVO_{al}$, a $BVO_{al}$-$BVO_{al}$ and a $BVO_{al}$-$BVO_{ac}$ homojunction under illumination in 0.1 M potassium borate buffer without 0.1 M sodium sulfite at 1.23 V vs RHE.
Figure 10B:
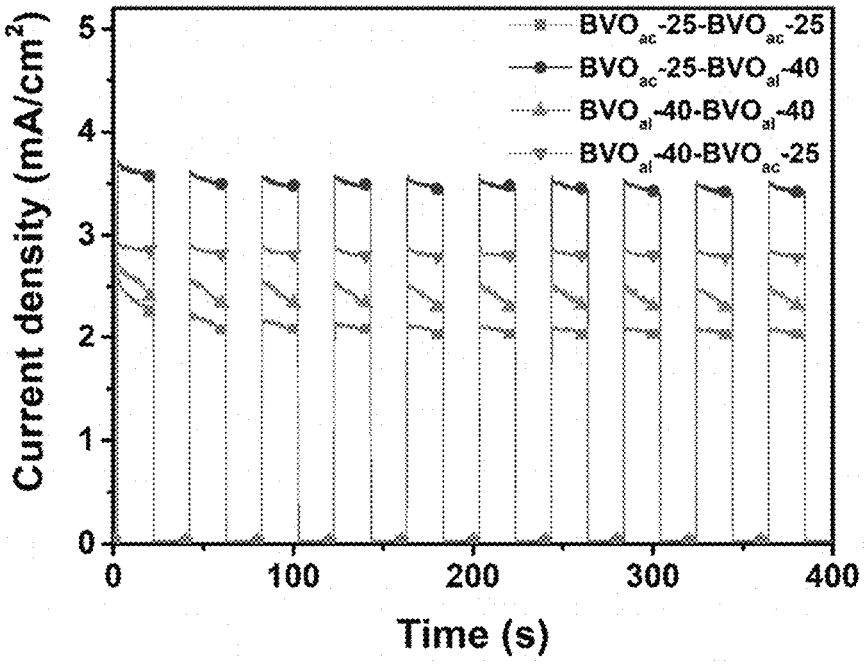
FIG. 10B is a graph showing the transient photocurrent density of an embodiment of a $BVO_{ac}$-$BVO_{ac}$, a $BVO_{ac}$-$BVO_{al}$, a $BVO_{al}$-$BVO_{al}$ and a $BVO_{al}$-$BVO_{ac}$ homojunction under illumination in 0.1 M potassium borate buffer with 0.1 M sodium sulfite at 1.23 V vs RHE.

FIGS. 10A and 10B show the transient photocurrent density of $BVO_{ac}$-$BVO_{ac}$, $BVO_{ac}$-$BVO_{al}$, $BVO_{al}$-$BVO_{al}$ and $BVO_{al}$-$BVO_{ac}$ homojunction in the buffer without/with 0.1 M sodium sulfite. In both graphs, the $BVO_{ac}$-$BVO_{al}$ homojunction exhibits improved performance than the $BVO_{ac}$-$BVO_{ac}$, the $BVO_{al}$-$BVO_{al}$ and the $BVO_{al}$-$BVO_{ac}$ homojunctions.

Figure 11:
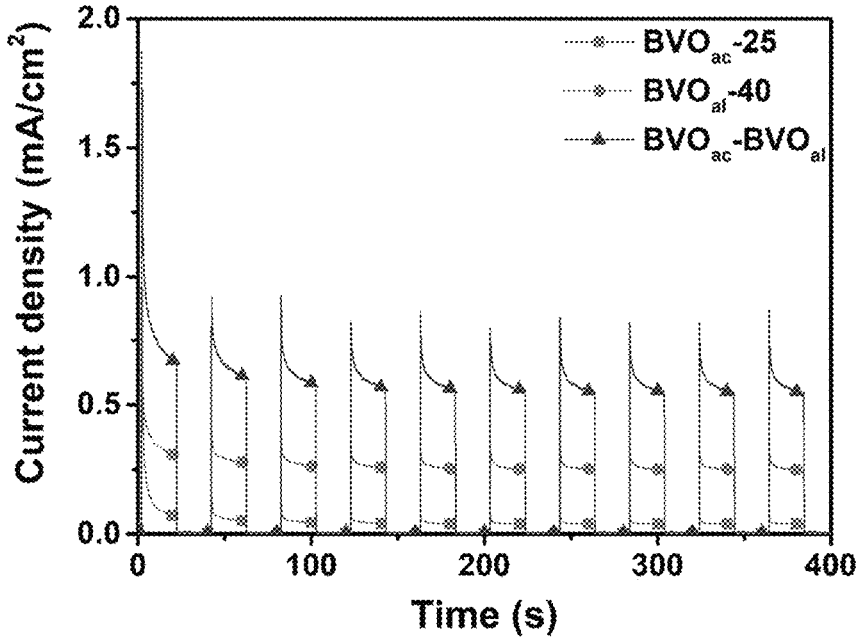
FIG. 11 is a graph showing chopped transient currents density curves of an embodiment of a $BVO_{ac}$-25, a $BVO_{al}$-40 and a $BVO_{ac}$-$BVO_{al}$ homojunction at 1.23 eV vs. RHE in 0.1M potassium borate buffer.
Figure 12:
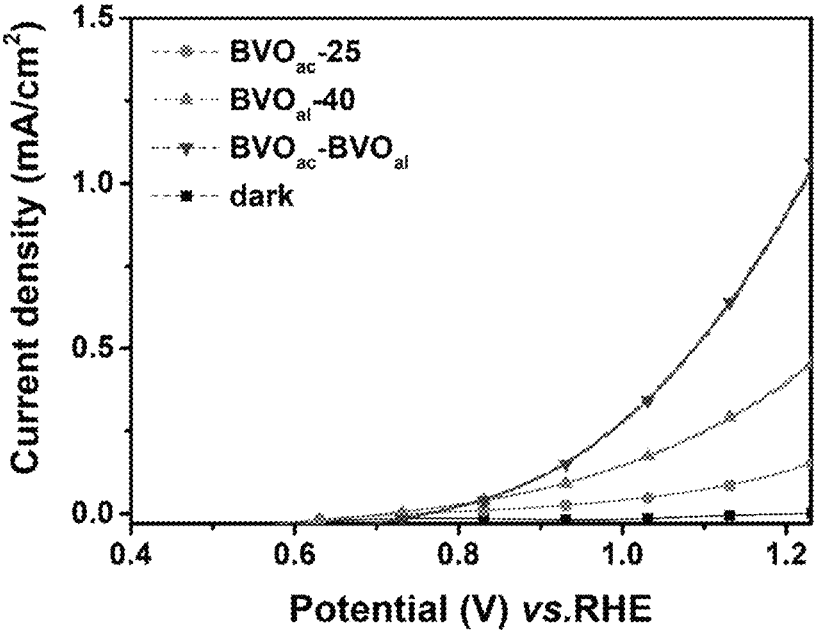
FIG. 12 is a graph showing linear sweep voltammetric (LSV) curves of an embodiment of a $BVO_{ac}$-25, a $BVO_{al}$-40 and a $BVO_{ac}$-$BVO_{al}$ homojunction under the illumination from the substrate to the electrode in 0.1M potassium borate buffer.

FIG. 11 compares the chopped transient current density of single-layer $BVO_{ac}$-25, $BVO_{al}$-40 and $BVO_{ac}$-$BVO_{al}$ homojunction. FIG. 12 is an embodiment of the linear sweep voltammetric (LSV) curves of the current density of single-layer $BVO_{ac}$-25, $BVO_{al}$-40 and $BVO_{ac}$-$BVO_{al}$ homojunction. The results show that $BVO_{ac}$-$BVO_{al}$ homojunction exhibits the best PEC photocurrent density.

Figure 13:
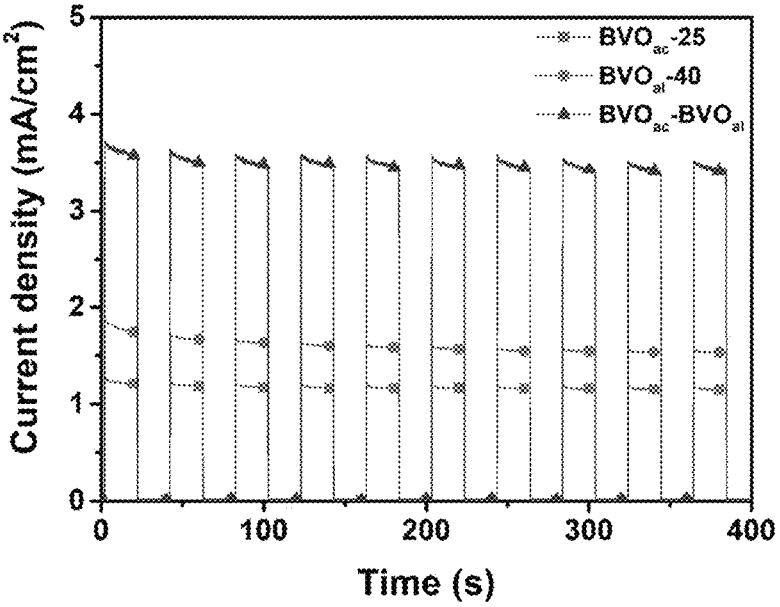
FIG. 13 is a graph showing I-t curves of an embodiment of a $BVO_{ac}$-25, a $BVO_{al}$-40 and $BVO_{ac}$-$BVO_{al}$ homojunction at 1.23 V vs. RHE in 0.1 M potassium borate buffer with 0.1 M $Na_2SO_3$ as a hole scavenger under 1 sunlight illumination (AM 1.5 G, 100 mW $cm^{-2}$).

FIG. 13 compares the current density of $BVO_{ac}$-25, $BVO_{al}$-40 and $BVO_{ac}$-$BVO_{al}$ homojunction at 1.23 V vs. RHE in 0.1 M KB buffer with 0.1 M $Na_2SO_3$. The $BVO_{ac}$-$BVO_{al}$ homojunction achieves outstanding PEC performance, with a photocurrent density of 3.6 $mA/cm^2$ at 1.23 V vs. RHE.

Figure 14A:
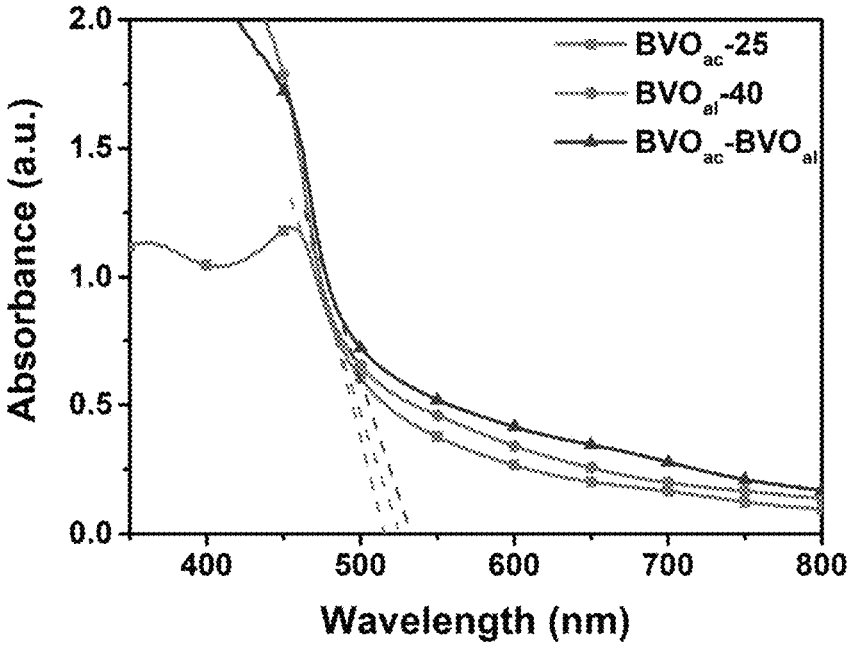
FIG. 14A is a graph showing UV-vis spectra of an embodiment of a $BVO_{ac}$-25, a $BVO_{al}$-40 and a $BVO_{ac}$-$BVO_{al}$ homojunction.
Figure 14B:
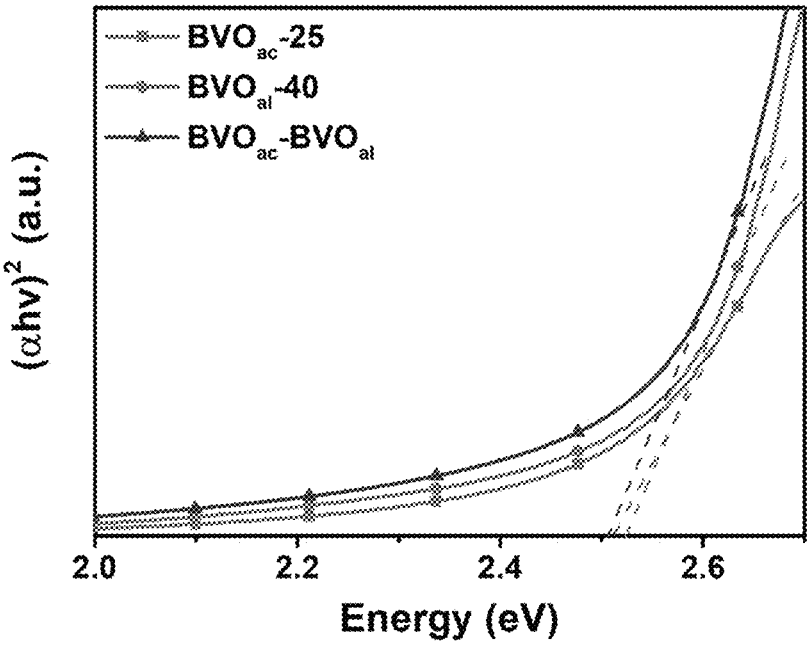
FIG. 14B is a graph showing Tauc plot of an embodiment of a $BVO_{ac}$-25, a $BVO_{al}$-40 and a $BVO_{ac}$-$BVO_{al}$ homojunction.
Figure 14C:
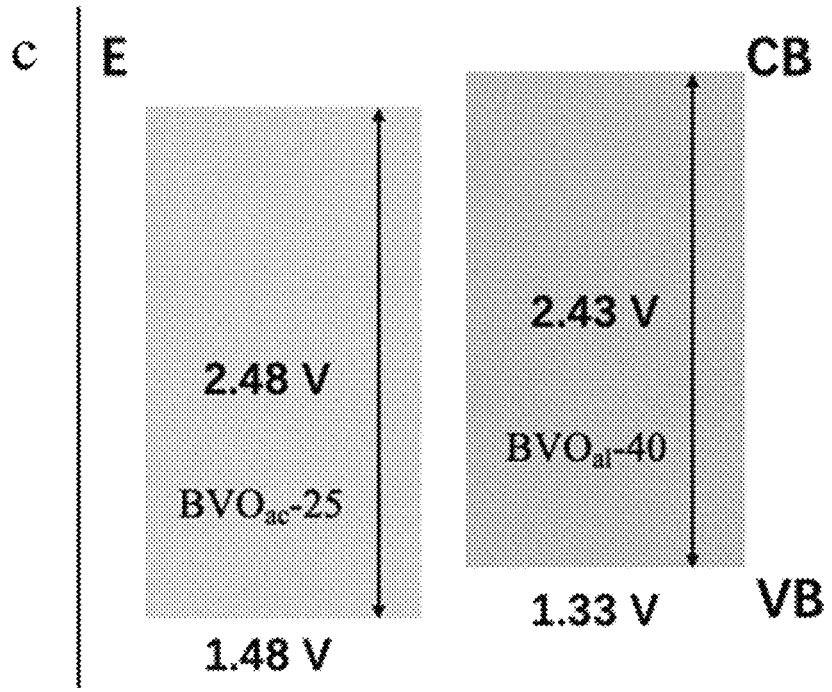
FIG. 14C is a graph showing band diagram schematic of an embodiment of a $BVO_{ac}$-25 and a $BVO_{al}$-40.

FIG. 14A shows an embodiment of the Ultraviolet-Visible (UV-Vis) absorption spectra of $BVO_{ac}$-25, $BVO_{al}$-40 and $BVO_{ac}$-$BVO_{al}$ homojunction. The spectra of the $BVO_{ac}$-$BVO_{al}$ homojunction exhibit the characteristic absorption edge at about 500 nm. FIG. 14B is an embodiment of the Tauc plot by UV-vis absorption spectroscopy of $BVO_{ac}$-25, $BVO_{al}$-40 and $BVO_{ac}$-$BVO_{al}$ homojunction. FIG. 14C shows an embodiment of the calculated band diagram schematic of the $BVO_{ac}$-25 film and the $BVO_{al}$-40 film from FIG. 14B.

Figure 15A:
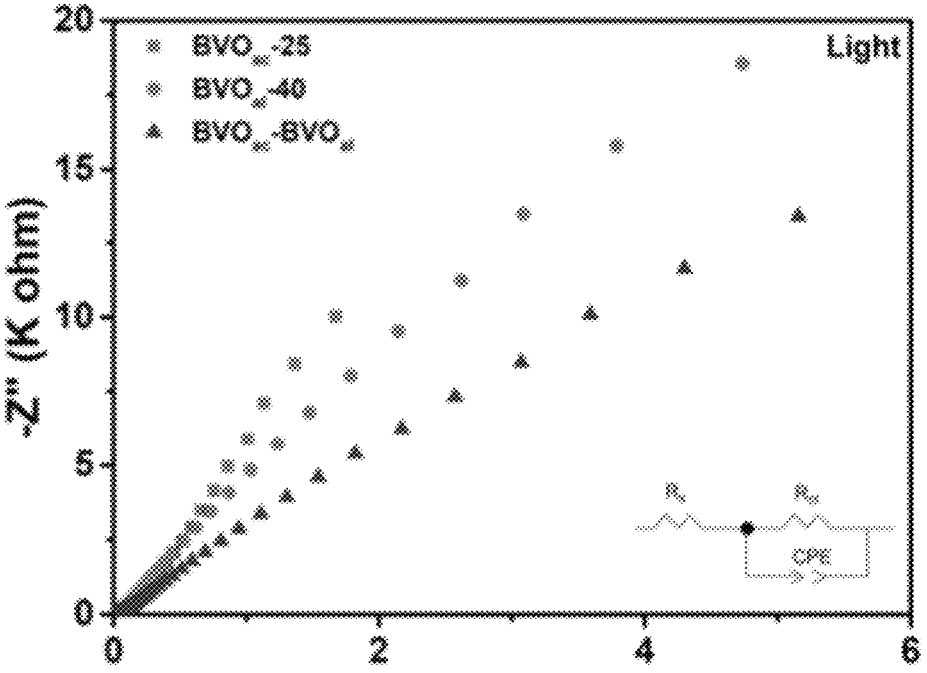
FIG. 15A is a graph showing Nyquist plots (Insert: the equivalent circuit model) of an embodiment of a $BVO_{ac}$-25, a $BVO_{al}$-40 and a $BVO_{ac}$-$BVO_{al}$ homojunction under illumination.
Figure 15B:
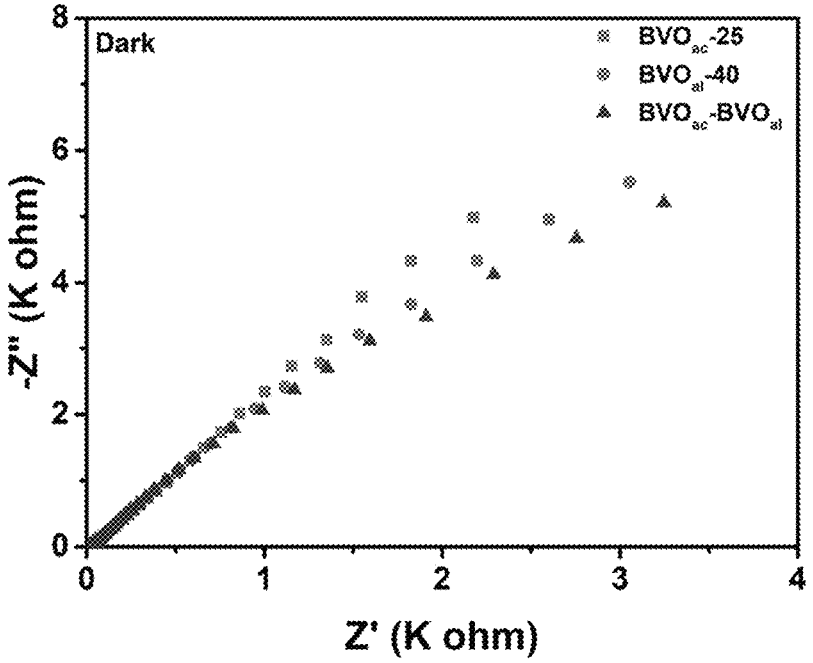
FIG. 15B is a graph showing Nyquist plots of an embodiment of a $BVO_{ac}$-25, a $BVO_{al}$-40 and a $BVO_{ac}$-$BVO_{al}$ homojunction in the dark.

FIG. 15A is an embodiment of the electrochemical impedance spectroscopy (EIS) curves of the BiVO4 films under illumination. The equivalent circuit model inserted in FIG. 15A is composed of a series resistance (Rs), a charge transfer resistance (Rct) and a constant phase angle element (CPE), which is applied to understand the origin of the EIS results further. FIG. 15*b* is an embodiment of the electrochemical impedance spectroscopy (EIS) curves of the $BiVO_4$ films under darkness. From FIGS. 15A and 15B, the $BVO_{ac}$-$BVO_{al}$ homojunction has the smallest resistance on the interface between the electrode and electrolyte.

Figure 16:
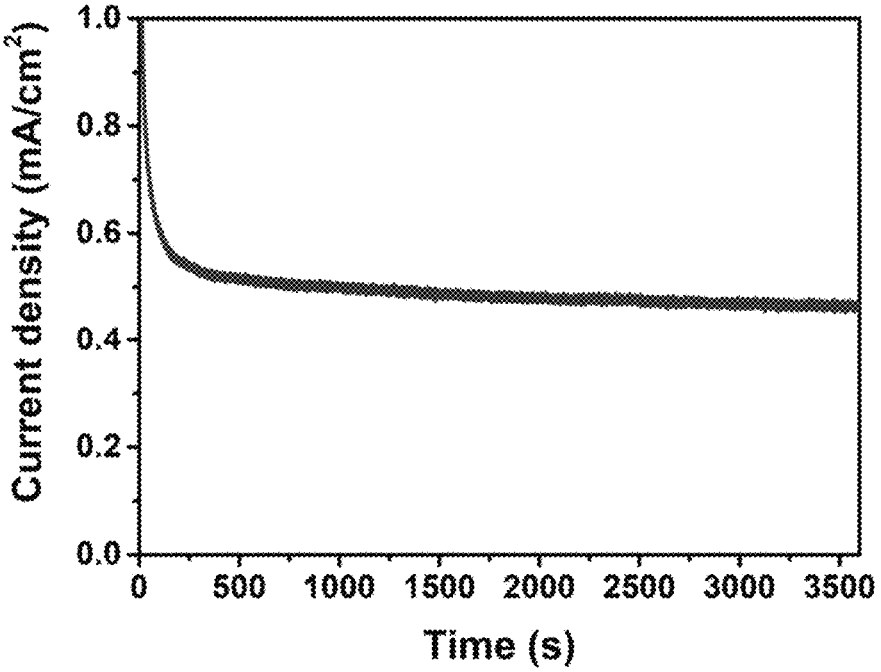
FIG. 16 is a graph showing the transient photocurrent density of an embodiment of a $BVO_{ac}$-$BVO_{al}$ homojunction assessed at 1.23 V vs. RHE in 0.1 M potassium borate buffer under 1 sunlight illumination for 1 h.

FIG. 16 is an embodiment of the photostability of the electrodeposited $BVO_{ac}$-$BVO_{al}$ homojunction. After 300s, the photocurrent only drops 5.8%. It shows that the photoelectrocatalyst of $BVO_{ac}$-$BVO_{al}$ homojunction has pretty good stability, which can be used for a long time with a stable performance Materials In this invention, acetone is purchased from Anaqua Global International Inc., Limited (Cleveland, OH, USA). Isopropanol is provided by Dieckmann Chemical Industry Company Ltd (Shenzhen, China). Sodium hydroxide (NaOH) is purchased from Acros Organics Company (Geel, Belgium or New Jersey, USA). Nitric acid ($HNO_3$) is obtained from VWR International Company Ltd (Shanghai, China). 2,3-dihydroxybernsteinsaeure, vanadium (IV)oxy acetylacetonate and glacial acetic acid are purchased from Aladdin Biochemical Technology Company, Ltd (Shanghai, China). Bismuth (III) nitrate pentahydrate ($Bi(NO)_3 \cdot 5H_2O$), sodium sulfate ($Na_2SO_4$) and sodium sulfite ($Na_2SO_3$) are purchased from Sigma-Aldrich LLC (Shanghai, China). Potassium borate ($K_2B_4O_7 \cdot 4H_2O$) is bought from Sinopharm Chemical Reagent Co., Ltd (Shanghai, China). All the chemical reagents were analytical grade and used without any further purification.

Example 1

Synthesis of $BiVO_4$ Single-Layer Films

All the $BiVO_4$ films in this work are first fabricated via an electrodeposition method and followed by a thermal evaporation process. The electrodeposition of the bismuth precursor on the substrate occurs via a three-electrode cell system at a constant potential in acidic or alkaline electrolytes, respectively. Afterwards, a thermal evaporation method is applied to the vanadium precursor, allowing it to fully react with the bismuth precursor on the substrate. The $BiVO_4$ thin film forms gradually during this annealing process, as illustrated in FIG. 1. Without intending to be limited by theory it is believed that all conductive substrates are potentially-applicable to the present invention. The conductive substrates contain conductive materials. The conductive substrates can be selected from the group of metals, graphitic carbon film, fluorine doped tin oxide coated (FTO) glass indium tin oxide coated glass (ITO glass) and a combination thereof, or FTO glass, ITO glass, graphitic carbon film, metals, and a combination thereof, or FTO glass. During the electrodeposition process, it is observed that the deposition rate of the bismuth precursor in an alkaline electrolyte is much faster than that in an acidic electrolyte. The detailed procedures are as follows.

Bismuth precursor films are firstly electrodeposited in the acidic and alkaline electrolytes, respectively. FTO glasses (NSG, 2.2 mm, 7Ω $sq^{-1}$) are ultrasonically cleaned by a mixture of deionized (DI) water, acetone and isopropanol (1:1:1 vol. %) for 15 mins, then ultrasonically washed by DI water for another 15 mins and dried in the furnace for further use.

An acidic electrolyte for $BVO_{ac}$: 0.6 g 2,3-dihydroxybernsteinsaeure (99.5%) is dissolved in a mixture of 30 mL DI water, 5 mL glacial acetic acid (99.8%) and 1 mL 1 M NaOH (97%) solution. The pH value of the mixture is exactly tuned to 2 by adding 0.5 M $HNO_3$ (69%). Then, 4.336 g $Bi(NO)_3 \cdot 5H_2O$ (98%) is added to the mixture with continuous magnetic stirring at 50° C. for 1 h. The acidic electrolyte is ready for use after being purged by nitrogen flow for 15 min.

An alkaline electrolyte for $BVO_{al}$: 1.352 g 2,3-dihydroxybernsteinsaeure and 4.366 g $Bi(NO)_3 \cdot 5H_2O$ are added into 30 mL DI water. The pH value of the mixture is regulated to 13 by adding 1 M NaOH and the white suspension changed into transparent during this process.

The electrodeposition method is carried out in a three-electrode cell system to prepare the bismuth precursor films. The three electrodes (working electrode: FTO substrate, counter electrode: platinum foil, reference electrode: Ag/AgCl electrode) are distributed in an equilateral triangle with a side length of 1.8 cm and are immersed in the electrolyte. The external bias is set to 2.6 V vs. RHE for the acidic electrolyte and 2.3 V vs. RHE for the alkaline electrolyte. The electrodeposition in the acidic electrolyte may take from about 0.5 minutes to about 120 minutes; or from about 1 minute to about 90 minutes; or from about 5 minutes to about 60 minutes; or from about 10 minutes to about 40 minutes; or about 25 minutes. The electrodeposition in the alkaline electrolyte may take from about 10 seconds to about 100 seconds; or from about 20 seconds to about 70 seconds; or from about 30 seconds to about 50 seconds; or about 40 seconds.

70 mg vanadium(IV)oxy acetylacetonate (vanadium precursor) is uniformly spread in the bottom of a square corundum crucible. The bismuth precursor films are then placed face down to cover the crucible. The square corundum crucible is moved to the muffle furnace and annealed at about 300-600° C. (heating rate: about 0.5-30° C./min) in the air for about 0.1-5 h. In a preferred example, the square corundum crucible is moved to the muffle furnace and annealed at 500° C. In a preferred example, the heating rate is about 2-3° C./min. In a more preferred example, the heating rate is about 2° C./min. In a preferred example, the annealing in the air lasts for about 2-3 h. During the annealing process, the as-coated bismuth precursor converted into $BiVO_4$ gradually. Finally, the $BiVO_4$ photoanodes are immersed in 1M NaOH solution for 15 mins to wash away the residual $V_2O_5$ on the surface.

Example 2

Construction of the $BiVO_4$ Double-Layer Homojunction

Two types of $BiVO_4$ homojunctions that consist of $BVO_{al}$-40 and $BVO_{ac}$-25 single-layer films are constructed. The one employs a $BVO_{al}$-40 as the first layer and $BVO_{ac}$-25 as the second layer is denoted as $BVO_{al}$-40-$BcVO_{ac}$-25. Another one that employs $BVO_{ac}$-25 as the first layer and $BVO_{al}$-40 as the second layer is denoted as $BVO_{ac}$-25-$BVO_{al}$-40. $BVO_{al}$-40-$BVO_{ac}$-25: The bismuth precursor films is firstly electrodeposited in an alkaline electrolyte (pH=13) for 40 seconds followed by the thermal evaporation of vanadium precursor at 500° C. (heating rate: 2° C./min) in the air for 2 h to form the first layer—$BVO_{al}$-40. Then it is electrodeposited again in acidic (pH=2) electrolyte for 25 mins followed by the thermal evaporation of vanadium precursor at 500° C. (heating rate: 2° C./min) in the air for 2 h to construct the second layer—$BVO_{ac}$-25.

$BVO_{ac}$-25-$BVO_{al}$-40: The Bismuth precursor films are electrodeposited for 25 mins in acidic (pH=2) electrolyte firstly followed by the thermal evaporation of vanadium precursor at 500° C. (heating rate: 2° C./min) in the air for 2 h to form the first layer—$BVO_{ac}$-25. Then it is electrodeposited again in an alkaline electrolyte (pH=13) for 40 seconds followed by the thermal evaporation of vanadium precursor at 500° C. (heating rate: 2° C./min) in the air for 2 h to construct the second layer—$BVO_{al}$-40.

The $BiVO_4$ films deposited in acidic or alkaline electrolytes have different electronic structures. After combining the two films together, an n-$n^+$ type II homojunction is achieved. The architecture can facilitate the electron-hole separation at the $BVO_{al}$-$BcVO_{ac}$ or $BVO_{ac}$-$BVO_{al}$ interface, by introducing a built-in electric field.

Example 3

Characterization of the $BiVO_4$ Double-Layer Homojunction by SEM and XRD

The observation of the film morphology was carried out on a scanning electron microscope (SEM, Zeiss Sigma 300). The crystalline structure is confirmed by X-ray diffractometer (XRD, Rigaku smartlab 9 kw) with Cu Kα (k=1.54051 Å) irradiation.

From the top-view SEM images (FIGS. 2A-B, FIG. 3A-D), all the $BiVO_4$ films show flower-like surface morphology. With the uniform structure, synthesized $BiVO_4$ films can effectively solve the problem of surface agglomeration. Among all $BiVO_4$ films, the $BVO_{ac}$-25 bare layer possesses a denser topography with an average particle size of ~200 nm than that of the $BVO_{al}$-40 bare layer (FIG. 3*a*-3*d*). Compared with the $BVO_{ac}$-25 bare layer, the $BVO_{al}$-40 bare layer is more porous, which is believed to possess more oxygen vacancies that are beneficial for OER. Though $BVO_{ac}$-$BVO_{al}$ homojunction film shows a similar film morphology to the $BVO_{al}$-40 film, it has the largest nanoparticle size of ~450 nm. The cross-sectional view SEM images (FIG. 2B inset, FIG. 3B inset, 3D inset) show that the thickness of the $BiVO_4$ single-layer films is 100 nm, while that of the $BVO_{ac}$-$BVO_{al}$ double-layer is 200 nm. The thickness of the layers is related to the deposition time. The synthesized $BiVO_4$ single-layer films are thin in the nanoscale. The XRD patterns (FIG. 4) of all the as-prepared $BiVO_4$ photoanodes display similar diffraction peaks, which is in accordance with that of monoclinic scheelite $BiVO_4$ (standard card JCPDS 00-014-0688) and the FTO substrate. No obvious peaks from the other impurities can be observed, suggesting that the composition of all the as-prepared $BiVO_4$ films contains the $BiVO_4$ phase only. However, unlike $BVO_{ac}$-25 and $BVO_{al}$-40 single-layer films present (110) crystal face (2θ=18.8°) preferred orientation, the $BVO_{ac}$-$BVO_{al}$ homojunction shows no obvious crystal face preferred orientation.

Example 4

Characterization of the $BiVO_4$ Double-Layer Homojunction by XPS

The chemical composition is achieved using X-ray photoelectron spectroscopy (XPS, Thermo SCIENTIFIC K-Alpha). As shown in FIG. 5, there are only Bi, V, C and O elements shown in the XPS survey scans, indicating that all the as-deposited films consist of $BiVO_4$ only.

Oxygen vacancies, a kind of defect as well as an essential kind of dopants, have been reported that they can improve the PEC performance of $BiVO_4$. Oxygen vacancies, as a critical class of dopants, could serve as surface electron-trapping sites to promote charge separation and increase the electron conductivity of the $BiVO_4$ photoanode. In order to investigate the surface composition and the amount of oxygen vacancies on the $BiVO_4$ photoanodes, XPS spectra are obtained from both $BiVO_4$ single-layer films and the $BVO_{ac}$-$BVO_{al}$ homojunction. In order to analyze the impact of the oxygen vacancies on the PEC performance, the high-resolution O 1s core level XPS spectrum is achieved.

As shown in FIG. 6A, the O is spectra for all the $BiVO_4$ film embodiments can be split into three peaks that represent the lattice oxygen ($O_L$), the hydroxyl groups (surface oxygen vacancies, $O_V$), and the chemisorbed oxygen species from the water ($O_C$), respectively. Particularly, the $O_V$ and $O_C$ peaks locate at 531.20 eV and 532.20 eV for all the $BiVO_4$ films. However, the $O_L$ peaks of the $BVO_{ac}$-25, the $BVO_{al}$-40 and the $BVO_{ac}$-$BVO_{al}$ homojunction locate at 529.68 eV, 529.60 eV, and 529.5 eV, respectively. The content of $O_L$, $O_V$ and $O_C$ of BVOac-25, BVOal-40 and BVOac-BVOal are calculated in Table 1.

TABLE 1

The atomic percentage of $O_L$, $O_V$ and $O_C$ in XPS spectra of $BVO_{ac}$-25, $BVO_{al}$-40 and $BVO_{ac}$-$BVO_{al}$ obtained from XPS data.

| | $O_L$ (at. %) | $O_V$ (at. %) | $O_C$ (at. %) |
|---|---|---|---|
| $BVO_{ac}$-25 | 66.73 | 12.42 | 20.85 |
| $BVO_{al}$-40 | 61.10 | 25.66 | 13.24 |
| $BVO_{ac}$-$BVO_{al}$ | 62.52 | 30.80 | 6.68 |

With respect to single-layer films, $BVO_{al}$-40 owns more oxygen vacancies than $BVO_{ac}$-25. More impressively, the content of $O_V$ for the $BVO_{ac}$-$BVO_{al}$ homojunction is the highest (30.80 at. %), revealing it possesses the most oxygen vacancies on its film surface.

The combined homojunction has more oxygen vacancies which can serve as surface electron-trapping sites to promote charge separation and increase the electron conductivity of the $BiVO_4$ photoanode. The combined homojunction also has a built-in electric field which can facilitate the electron-hole separation at the $BVO_{ac}$/$BVO_{al}$ interface. All these contribute to the improvement of the performance of homojunction.

In FIG. 6B, the Bi species in the $BVO_{ac}$-$BVO_{al}$ homojunction, are mainly present as $Bi^{3+}$ since the characteristic peaks of 158.93 eV and 164.24 eV arise from Bi $4f_{7/2}$ and Bi $4f_{5/2}$. The V 2p core level XPS spectra (FIG. 6C) for all samples can be fitted with three peaks at ~515.50 eV ($V2p_{3/2}$), ~516.45 eV (V $2p_{3/2}$), and ~523.82 eV (V $2p_{1/2}$), among which the V $2p_{3/2}$ peaks at ~515.50 eV and ~516.45 eV correspond to the surface $V^{4+}$ and $V^{5+}$ species, respectively. The content of the $V^{4+}$ species in the $BVO_{ac}$-$BVO_{al}$ homojunction is ~4.78 at. %, which is higher than that of $BVO_{ac}$-25 and $BVO_{al}$-40 films. According to the electroneutrality principle, the higher content of the $V^{4+}$ species refers to more oxygen vacancies. The different concentrations of oxygen vacancies show that the single films have different electronic structures.

Those $V^{4+}$ species bonded with $O_L$ cause a negative shift of the $O_L$ peak as shown in FIG. 6A. Compared with the position of Bi 4f and V 2p spectra for $BVO_{ac}$-25 film, negative shifts of ~0.28 eV and ~0.25 eV are observed in the $BVO_{ac}$-$BVO_{al}$ homojunction, which attributes to the changes in the coordination chemical environments of Bi and V elements caused by the existing oxygen vacancies. The valence band edge position can also be obtained from the XPS spectra as shown in FIG. 7. It shows that oxygen vacancies have an impact on the electronic structure of $BiVO_4$, resulting in a shift in the valence band edge position, which may narrow the band gap and absorb more light energy in photoelectrochemical water splitting.

Moreover, the formation and the energy band schematic of the $BVO_{ac}$-$BVO_{al}$ homojunction are demonstrated in FIG. 8. Oxygen vacancies act as shallow donors and take responsibility for the n-type conductivity. The $BVO_{al}$-40 film has more oxygen vacancies than the $BVO_{ac}$-25 film, which may arise from $OH^-$ solution species in the alkaline electrolyte competing with the $V^{5+}$ precursor species to react with the interfacially electrogenerated $Bi^{3+}$, leading to more oxygen atoms escaping from the crystal lattice. The $BVO_{al}$-40 film with higher content of oxygen vacancies leads to a shift of the Fermi level to the conduction band (CB). Thus, it is believed that the different content in oxygen vacancies of two films causes a relative band bending across the homojunction to enhance the charge separation efficiency.

Example 5

Photoelectrochemical Measurement of the $BiVO_4$ Double-Layer Homojunction

It is well known that the thickness of the photoanode is a trade-off between ensuring sufficient light absorption and efficient charge transportation. Thus, in order to optimize the thickness of the double-layer $BiVO_4$ homojunction, the photoelectrochemical (PEC) performance of the $BiVO_4$ homojunctions of different thicknesses is investigated.

The PEC properties of embodiments of $BiVO_4$ photoanodes are evaluated in a standard three-electrode system by the electrochemical station (CHI 760E, Shanghai Chenhua Limited, Shanghai, China). Before the measurement, all the samples are cut into identical pieces and then sealed with epoxy resin to avoid current leakage. The active area of the films is kept constant at 0.5 $cm^2$ to contact and react with the electrolyte. The three-electrode systems ($BiVO_4$ photoanode as the working electrode, platinum foil as the counter electrode, Ag/AgCl electrode as the reference electrode) are immersed into the electrolyte (pH=9.41) consisting of 0.1 M potassium borate electrolyte ($K_2B_4O_7 \cdot 4H_2O$, 99.5%). And another type of electrolyte (pH=9.44) is 0.1M $K_2B_4O_7 \cdot 4H_2O$ electrolyte added with 0.1 M $Na_2SO_3$ (99%) as the hole scavenger. The applied potential vs Ag/AgCl is converted to the reversible hydrogen electrode (RHE) scale according to the Nernst equation:

$$E_{RHE} = E_{Ag/AgCl} + 0.059 \times Ph + E^{\circ}_{Ag/AgCl}.$$

where $E^{\circ}_{Ag/AgCl}$=0.197 V at 25° C.

A 300 W Xe lamp (NewBet HSX-F300) equipped with AM 1.5 G filter is used as the Sun simulator. The power density of the illumination is calibrated to be 100 mW/cm$^2$. Transient photocurrent density (i-t) is measured by applying a bias of 1.23 V vs. RHE under chopped illumination (on: 20 s, off: 20 s). Linear sweep voltammetry (LSV) is recorded by sweeping the potential from negative to positive direction with a scan rate of 10 mV/s.

Different homojunctions, $BVO_{ac}$-15-$BVO_{al}$-25, $BVO_{ac}$-15-$BVO_{al}$-40, $BVO_{ac}$-15-$BVO_{al}$-55, $BVO_{ac}$-25-$BVO_{al}$-25, $BVO_{ac}$-25-$BVO_{al}$-40 and $BVO_{ac}$-25-$BVO_{al}$-55 are prepared. Similar to the preparation described in Example 2 of $BVO_{ac}$-25-$BVO_{al}$-40, $BVO_{ac}$-15-$BVO_{al}$-25 homojunction is prepared by the first deposition in an acidic electrolyte for 15 mins and followed by the second deposition in an alkaline electrolyte for 25 seconds. $BVO_{ac}$-15-$BVO_{al}$-40 homojunction is prepared by the first deposition in an acidic electrolyte for 15 mins and followed by the second deposition in an alkaline electrolyte for 40 seconds. $BVO_{ac}$-15-$BVO_{al}$-55 homojunction is prepared by the first deposition in an acidic electrolyte for 15 mins and followed by the second deposition in an alkaline electrolyte for 55 seconds. $BVO_{ac}$-25-$BVO_{al}$-25 homojunction is prepared by the first deposition in an acidic electrolyte for 25 mins and followed by the second deposition in an alkaline electrolyte for 25 seconds. $BVO_{ac}$-25-$BVO_{al}$-55 homojunction is prepared by the first deposition in an acidic electrolyte for 25 mins and followed by the second deposition in an alkaline electrolyte for 55 seconds.

As shown in FIG. 9, the embodiment of $BVO_{ac}$-25-$BVO_{al}$-40 ($BVO_{ac}$-$BVO_{al}$ homojunction) shows the highest current density and its fabrication parameters are adopted as the optimized thickness. A higher current density contributes to a higher ability for water splitting. In addition, different types of homojunction are prepared to understand the impact of the film architecture on their PEC performance. It turns out that the $BVO_{ac}$-$BVO_{al}$ homojunction outperforms the $BVO_{ac}$-$BVO_{ac}$, the $BVO_{al}$-$BVO_{al}$ and the $BVO_{al}$-$BVO_{ac}$ homojunction in PEC performance (FIGS. 10A and 10B). Without intending to be limited by theory, it is believed that, among these 4 homojunctions, only $BVO_{ac}$-$BVO_{al}$ is a n-n$^+$ homojunction that can cause a relative band bending at the homojunction to enhance the charge separation efficiency across the homojunction. Thus, the desired architecture of the $BiVO_4$ homojunction adopts $BVO_{ac}$-$BVO_{al}$ homojunction, which consists of a $BVO_{ac}$ as the first layer and a $BVO_{al}$ as the second layer.

Example 6

$BVO_{ac}$-$BVO_{al}$ Homojunction Shows Improved PEC Performance

The thickness of the $BVO_{ac}$-$BVO_{al}$ homojunction is optimized firstly (FIG. 9). The chopped transient currents density (i-t) and the linear sweep voltammetric (LSV) curves of embodiments of $BVO_{ac}$-25, $BVO_{al}$-40 and $BVO_{ac}$-$BVO_{al}$ homojunctions under AM 1.5G illumination (100 mW/cm$^2$) at the potential of 1.23 V vs. RHE are shown in FIGS. 11 and 12, respectively. FIGS. 11 and 12 indicate the $BVO_{ac}$-$BVO_{al}$ homojunction exhibits the superior PEC photocurrent density, reaching 0.7 mA/cm$^2$ at 1.23 V vs. RHE. In addition, all the $BiVO_4$ photoanodes show negligible dark current density, suggesting there is a good photoresponse. Besides, the i-t curves of $BVO_{ac}$-25, $BVO_{al}$-40 and $BVO_{ac}$-$BVO_{al}$ homojunction at 1.23 V vs. RHE in 0.1 M KB buffering with 0.1 M $Na_2SO_3$ as a hole scavenger are shown in FIG. 13. The $BVO_{al}$-40 film that electrodeposited in alkaline electrolyte only shows an enhanced photocurrent density of 1.6 mA/cm$^2$ at 1.23 V vs RHE. And the $BVO_{ac}$-25 film shows an inferior photocurrent density of 1.2 mA/cm$^2$ at 1.23 V vs. RHE. The $BVO_{ac}$-$BVO_{al}$ homojunction that electrodeposited in acidic electrolyte firstly and then in alkaline electrolyte achieves outstanding PEC performance, displaying a photocurrent density of 3.6 mA/cm$^2$ at 1.23 V vs. RHE, which is 3 times higher than that of the single-layer $BiVO_4$ photoanode. Although no metal heteroatoms are incorporated, the $BVO_{ac}$-$BVO_{al}$ homojunction in this work shows improved PEC performance compared with most of the previously reported work related to $BiVO_4$-based homojunction (Table 2). It is believed that most prior arts try to achieve better PEC performances by incorporating traditional metal atoms, for example, Zn, Co, Mn, and Mo, into the homojunctions. However, the present invention exhibits comparable PEC performance to those existing homojunctions with metal heteroatoms. However, it is surprisingly found that despite not incorporating metal atoms, the photoanode designed in the present invention even shows better PEC performance than most listed homojunctions containing traditional metal atoms. Furthermore, it is believed that the manufacturing method and required conditions are far more facile and cost-effective than those requiring the introduction of traditional metal atoms. Therefore, it is believed that the remarkable PC activity of the $BVO_{ac}$-$BVO_{al}$ homojunction highlights the tremendous importance of reducing the charge recombination rate at the interface by constructing the homojunction and offers a strategy to form the heteroatoms-free $BiVO_4$ thin film with an efficient photoanode material for practical PC application. Accordingly, in an embodiment herein, the $BiVO_4$ film herein is substantially free of, or free of, a metal heteroatom; or a traditional metal heteroatom.

TABLE 2

Comparison of recently reported PEC performance of $BiVO_4$-based homojunctions with this invention.

| photoanode | electrolyte | pH | J(mA/cm$^2$@ 1.23 VsRHE | homojunction | J(mA/cm$^2$@ 1.23 VsRHE | reference |
|---|---|---|---|---|---|---|
| $BiVO_4$ | 0.1M KB + 0.1M $Na_2SO_3$ | 9.44 | 1.6 | $BVO_{ac}$-$BVO_{al}$ homojunction | 3.6 | This invention |
| $BiVO_4$ | 0.5M $Na_2SO_4$ | 7 | 0.21 | $BiVO_4$/Zn:$BiVO_4$ | 0.6 | ChemCatChem 2016, 8, 3279 |

TABLE 2-continued

Comparison of recently reported PEC performance of $BiVO_4$-based homojunctions with this invention.

| photoanode | electrolyte | pH | J(mA/cm$^2$@ 1.23 VsRHE | homojunction | J(mA/cm$^2$@ 1.23 VsRHE | reference |
|---|---|---|---|---|---|---|
| $BiVO_4$ | 0.1M KPi | 7 | 0.8 | Mo:$BiVO_4$/ Co:$BiVO_4$ | 2.09 | Apply Catalyst B Environmetal 2017, 211, 258 |
| $BiVO_4$ | $Na_2SO_4$ | 7 | 0.19 | $BiVO_4$/ Mn:$BiVO_4$ | 0.93 | Journal of Hydrogen Energy 2018, 43, 15815 |
| $BiVO_4$ | 0.5M KPi | 7 | 0.1 | Zn:$BiVO_4$/ Mo:$BiVO_4$ | 2.5 | Journal of Material Chemical A 2019, 10, 1039 |
| $BiVO_4$ | 1M KB | 9.5 | 1.83 | $BiVO_4$/ Mo:$BiVO_4$ | 3.42 | Chemical Engineering Journal 2021, 421, 127796 |
| $BiVO_4$ | 1M KB + 1M $Na_2SO_3$ | 9.5 | 2.81 | $BiVO_4$/ Mo:$BiVO_4$ | 4.57 | Chemical Engineering Journal 2021, 421, 127796 |
| $BiVO_4$ | 0.5M $Na_2SO_4$ + 0.1M PBS | 7.2 | 1.88 | W:$BiVO_4$/ Zn:$BiVO_4$ | 2.85 | Journal of Power Source 2021, 499, 229964 |

Example 7

$BVO_{ac}$-$BVO_{al}$ Homojunction Shows Long-Term Stability Under Illumination During the PEC Process In order to understand the underlying mechanism of how the $BVO_{ac}$-$BVO_{al}$ homojunction enhances the PEC performance, its optical property is investigated by the Ultraviolet-Visible (UV-vis) absorption spectroscopy as shown in FIG. 14A. The UV-Vis absorption spectra of the films are measured by VARIAN 50 Conc UV-visible Spectrophotometer. The spectra of the $BVO_{ac}$-$BVO_{al}$ homojunction exhibit the characteristic absorption edge at ~500 nm, which is related to the direct bandgap of scheelite monoclinic $BiVO_4$. The absorption edge of the $BVO_{ac}$-$BVO_{al}$ homojunction shifts to a longer wavelength compared to the single-layer $BiVO_4$ photoanodes, suggesting that the homojunction architecture can help to absorb more visible light. In order to determine the bandgap, the Tauc plot method (FIG. 14B) is also investigated by UV-vis absorption spectroscopy. The final band diagram schematic of the $BVO_{ac}$-25 film and the $BVO_{al}$-40 film calculated from the valence band gap position and Tauc plot is shown in FIG. 14C.

To understand the interfacial kinetics during the PEC process, electrochemical impedance spectroscopy (EIS) curves of the $BiVO_4$ films are measured at the open circuit potential under AM 1.5G illumination. Therefore, an equivalent circuit model (inserted in FIG. 15A) composed of a series resistance (Rs), a charge transfer resistance (Rct) and a constant phase angle element (CPE) is applied to further understand the origin of the EIS results. The charge transfer resistance on the interface between the electrolyte and the electrode can be calculated by measuring the diameter of the semicircle in the Nyquist plots at the lower frequency. As shown in FIGS. 15A and 15B, the diameter of the $BVO_{ac}$-$BVO_{al}$ homojunction has the smallest diameter both under illumination and in dark conditions, indicating that it has the smallest resistance on the interface between the electrode and electrolyte. It is believed that the $BVO_{ac}$-$BVO_{al}$ homojunction has the smallest resistance means when at the same condition with the constant applied voltage and sun energy, the homojunction can use more energy for separating electron-hole pairs, leading a better performance. In order to access the photostability of the electrodeposited $BVO_{ac}$-$BVO_{al}$ homojunction as the photoanode in the PEC cell, it is tested for 1 hour at 1.23 V vs. RHE under 1 sunlight illumination (FIG. 16). This phenomenon may arise from the aggregation of the photogenerated holes on the surface of the electrode upon light illumination. After 300s, the photocurrent only drops 5.8%, implying the homojunction shows long-term stability under the illumination during the PEC process, which can be used for a long time with a stable performance.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided separately, or in any suitable subcombination.

All references specifically cited herein are hereby incorporated by reference in their entireties. However, the citation or incorporation of such a reference is not necessarily an admission as to its appropriateness, citability, and/or availability as prior art to/against the present invention.

What is claimed is:

1. A method for fabricating a photoelectrode comprising a double-layer homojunction comprising the steps of;

(a) depositing a bismuth precursor onto a substrate via electrodeposition in a first electrolyte;

(b) thermal evaporating a vanadium precursor onto the substrate with the bismuth precursor under ambient pressure; and (c) cooling down the substrate to form a first layer of $BiVO_4$ film;

(d) depositing the bismuth precursor onto the substrate of step (c) via electrodeposition in a second electrolyte;

(e) thermal evaporating the vanadium precursor onto the substrate with the bismuth precursor under ambient pressure; and (f) cooling down the substrate to form a second layer of $BiVO_4$ film, wherein either the first electrolyte is an acidic electrolyte and the second electrolyte is an alkaline electrolyte or the first electrolyte is an alkaline electrolyte and the second electrolyte is an acidic electrolyte.

2. The method according to claim 1, wherein the substrate is selected from the group consisting essentially of FTO glass, ITO glass, graphitic carbon film, metals, and a combination thereof.

3. The method according to claim 1, wherein the pH of the acidic electrolyte is about 0.1-7, or about 2.

4. The method according to claim 1, wherein the pH of the alkaline electrolyte is about 7-14, or about 13.

5. The method according to claim 1, wherein the step of depositing the bismuth precursor onto the substrate via electrodeposition in the acidic electrolyte occurs for about 0.5 minutes to about 120 minutes, or about 25 minutes, and the step of depositing the bismuth precursor onto the substrate via electrodeposition in the alkaline electrolyte occurs for about 10 seconds to about 100 seconds, or about 40 seconds.

6. The method according to claim 1, wherein the thermal evaporating in steps (b) and (e) occurs in a muffle furnace at a temperature of about 300-600° C., or about 500° C.

7. The method according to claim 6, wherein the temperature is controlled at a heating rate of about 0.5-30° C./min, or about 2-3° C./min.

8. The method according to claim 1, wherein the thermal evaporating in steps (b) and (e) takes about 0.1-5 hours, or about 2-3 hours.

* * * * *